US011242778B2

(12) United States Patent
Batcheller et al.

(10) Patent No.: US 11,242,778 B2
(45) **Date of Patent: *Feb. 8, 2022**

(54) LOST MOTION EXHAUST ROCKER ENGINE BRAKE SYSTEM WITH ACTUATION SOLENOID VALVE AND METHOD OF OPERATION

(71) Applicant: Pacbrake Company, Blaine, WA (US)

(72) Inventors: Devin Batcheller, Surrey (CA); Kody Taylor, Surrey (CA); Vincent Meneely, Gibsons (CA)

(73) Assignee: Pacbrake Company, Blaine, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/013,963

(22) Filed: Sep. 8, 2020

(65) Prior Publication Data

US 2020/0400048 A1 Dec. 24, 2020

Related U.S. Application Data

(63) Continuation of application No. 16/374,867, filed on Apr. 4, 2019, now Pat. No. 10,767,522.

(Continued)

(51) Int. Cl.
*F02D 1/00* (2006.01)
*F01L 13/06* (2006.01)

(Continued)

(52) U.S. Cl.
CPC ..... *F01L 13/065* (2013.01); *F01L 1/181* (2013.01); *F02D 9/06* (2013.01); *F02D 13/04* (2013.01); *F01L 2305/00* (2020.05)

(58) Field of Classification Search
CPC ..... F01L 1/02; F01L 1/12; F01L 9/02; F01L 9/021; F01L 9/025; F01L 13/06;

(Continued)

(56) References Cited

U.S. PATENT DOCUMENTS 3,809,033 A * 5/1974 Cartledge ..... F01L 13/06 123/90.46
6,334,429 B1 * 1/2002 Little, Jr. ..... F01L 1/18 123/320

(Continued)

FOREIGN PATENT DOCUMENTS

CN 203594476 U 5/2014
EP 3246539 A1 11/2017
WO 2018034749 A1 2/2018

*Primary Examiner* — John Kwon
(74) *Attorney, Agent, or Firm* — Berenato & White, LLC

(57) ABSTRACT

A compression-release engine brake system for effectuating a compression-release engine braking operation of an internal combustion engine. The compression-release system includes a lost motion exhaust rocker assembly including an exhaust rocker arm, an actuation device including an actuation piston and an actuation cavity, and a reset device including a reset check valve and a slider-piston. Hydraulic fluid in the exhaust rocker arm is locked in the actuation cavity when the reset check valve is in the closed position, and flows through the reset check valve when the reset check valve is in the open position. The slider-piston is associated with the reset check valve so that in an extended position of the slider-piston the reset check valve is free to move toward the closed position, and in a retracted position of the slider-piston the reset check valve is moved to the open position thereof by the slider-piston.

19 Claims, 13 Drawing Sheets

Related U.S. Application Data

(60) Provisional application No. 62/652,424, filed on Apr. 4, 2018, provisional application No. 62/652,425, filed on Apr. 4, 2018.

(51) Int. Cl.

| | |
|---|---|
| ***F02D 9/06*** | (2006.01) |
| ***F02D 13/04*** | (2006.01) |
| ***F01L 1/18*** | (2006.01) |

(58) Field of Classification Search

CPC ..... F01L 13/065; F02D 9/06; F02D 13/04; F02D 41/12

USPC ..... 123/90.12, 90.16, 90.17, 90.46, 90.55, 123/90.63, 320–322

See application file for complete search history.

(56) References Cited

U.S. PATENT DOCUMENTS

| | | | | |
|---|---|---|---|---|
| 6,386,160 | B1 | 5/2002 | Meneely | |
| 9,429,051 | B2 | 8/2016 | Meneely | |
| 9,562,448 | B2 | 2/2017 | Meneely | |
| 9,752,471 | B2 | 9/2017 | Meneely | |
| 10,767,522 | B2 | 9/2020 | Batcheller | |
| 2014/0020644 | A1* | 1/2014 | Roberts | F01L 9/023 123/90.46 |
| 2015/0144096 | A1* | 5/2015 | Meneely | F01L 9/02 123/321 |
| 2015/0159521 | A1* | 6/2015 | Baltrucki | F01L 1/24 123/90.12 |
| 2015/0240671 | A1* | 8/2015 | Nakamura | F01L 1/10 123/90.16 |
| 2016/0305293 | A1* | 10/2016 | Meneely | F01L 1/26 |
| 2016/0356187 | A1* | 12/2016 | Meneely | F01L 1/181 |
| 2020/0088073 | A1* | 3/2020 | Baltrucki | F01L 9/02 |

* cited by examiner

LOST MOTION EXHAUST ROCKER ENGINE BRAKE SYSTEM WITH ACTUATION SOLENOID VALVE AND METHOD OF OPERATION

CROSS-REFERENCE TO RELATED APPLICATION AND CLAIM TO PRIORITY

This application is a continuation of U.S. patent application Ser. No. 16/374,867, filed Apr. 4, 2019, now U.S. Pat. No. 10,767,522, which claims the benefit of U.S. Provisional Patent Application Ser. No. 62/652,424 filed Apr. 4, 2018 by Taylor et al., and of U.S. Provisional Patent Application Ser. No. 62/652,425 filed Apr. 4, 2018 by Meneely et al., both of which are hereby incorporated herein by reference in their entirety and to which priority is claimed.

BACKGROUND OF THE INVENTION

1. Field of the Invention

The present invention relates to compression-release engine brake systems in general, and more particularly to a compression-release engine brake system and method comprising a lost motion exhaust rocker assembly including a reset mechanism, and a dual stage hydraulic solenoid brake system activation valve.

2. Description of the Related Art

Compression-release engine brake systems (or retarders) for diesel engines were designed and developed in North America starting in the early 1960's. There have been many changes that have been implemented that have increased retarding performance, reduced cost, and reduced engine loading.

Conventionally, compression-release engine brakes change a power producing diesel engine into a power absorbing air compressor for the purpose of retarding the vehicle. The engine, driven by the wheels, compresses the air in its cylinders on the compression stroke. This compressed air is then released into the exhaust manifold near top dead center (TDC) of the compression stroke. The compression release event occurs late enough in the stroke to allow cylinder pressure to build, yet early enough in the stroke to significantly reduce or eliminate the pressure on the following expansion stroke. Due to the cylinder pressure lost during the compression stroke, the return force, or rebound effect, pushing on the engine pistons as they move through the expansion stroke is minimized or eliminated. The net effect of this is an increase in driving power required from the wheels to keep the engine turning, and therefore an increase in retarding of the vehicle.

Opening of the exhaust valve(s) near top dead center (TDC) to vacate cylinder pressure has been accomplished by a number of different approaches. Some of the most common methods are add-on housings that hydraulically transfer intake or exhaust cam motion from a neighboring cylinder, or fuel injector motion from the same cylinder, to provide a method of timing the exhaust valve(s) to open near TDC of the compression stroke. Other compression-release engine brake systems utilize a dedicated cam lobe and rocker arm (or lever) to optimize the opening of the exhaust valve(s) near TDC of the compression stroke.

Another type of compression-release engine brake system provides a modification to the conventional exhaust cam lobe in order to integrate engine brake motion. This system adds an additional small lift profile to the exhaust cam lobe that is hidden or "lost" to the exhaust valve under normal engine operation via a larger than normal valve lash. When the engine brake is energized, the lash is removed and the motion is "found", such that the exhaust valve(s) are opened near TDC of the compression stroke. As such, this type of compression-release engine braking is termed "lost motion". Lost motion compression-release engine brakes are commonly integrated into an exhaust rocker arm, making them compact and cost effective.

In a multi-valve engine it is desirable to open only one exhaust valve for compression release in order to minimize valve-train loading, as the force required to hold each exhaust valve open is proportional to the cylinder pressure. However, if only one exhaust valve is opened with the lost motion compression-release engine brake, a connecting bridge between the exhaust valves may be tipped when normal exhaust valve motion commences, leading to side load and potential damage to the valve guides. An additional problem with the conventional lost motion brake system is that the additional valve lift used for compression-release engine braking is also added to the normal exhaust valve motion. Valve overlap between exhaust/intake strokes is extended, which can lower exhaust manifold pressure and decrease braking performance.

A reset device is known to mitigate these issues. After compression release, a reset device acts to close the open exhaust valve and restore normal exhaust valve motion during the exhaust stroke. Various methods of implementing a reset device in a lost motion integrated rocker arm engine brake exist in the art. Early rocker arm reset devices utilized normal exhaust valve motion to initiate resetting of the braked exhaust valve. This did not resolve the issue of a tilted valve bridge if single valve actuation is desired.

While known compression-release engine brake systems of the prior art with a reset device have proven to be acceptable for various applications, such devices are nevertheless susceptible to improvements that may enhance their performance, operational robustness, and reduce their cost and complexity.

SUMMARY OF THE INVENTION

A rocker arm compression-release engine brake system in accord with the present invention is an integrated resetting lost motion rocker arm engine brake system using a pressure sensitive biasing spring. The present invention solves the problems of the prior art by incorporating a reset mechanism into an active lash adjuster in the exhaust rocker arm. The reset device of the present invention utilizes a biasing spring, allowing it to restrain motion of the exhaust valve bridge and perform lost motion lash take-up even at low hydraulic fluid pressure. A dual stage hydraulic solenoid valve further optimizes integration simplicity by combining rocker lubrication and engine brake actuation into a single hydraulic circuit.

In a rocker in accord with the present invention, a slider piston in the reset actuator mechanism is in continuous contact, through a contacting foot, with the underlying valve bridge, and engages and actuates the underlying exhaust valve(s) in ordinary engine operation. A single set screw adjustment of the reset actuator accounts for both the lash of the engine braking reset actuator system and the lash of ordinary engine exhaust valve operation.

In operation, the slider piston is continuously extended from the rocker towards the valve bridge via a combination of mechanical (spring) and fluid pressure, and reciprocates within the actuator in a continuous uninterrupted manner. The reciprocating movement of the slider piston takes up the motion and lash imparted by supplemental lobes on the actuating cam profile for pre-charging (if present) and compression release, when the braking function is not energized. In this condition, the larger exhaust cam lobe profile rotates the rocker beyond all lash compensation and then actuates the exhaust valve(s) in the ordinary course of engine operation.

When the braking system is energized, the compression release actuator, positioned alongside the reset actuator in another bore within the rocker, and reset actuator are both fully extended from the rocker. However, it is only the compression release actuator, driven by the compression release cam profile in this extended configuration, that engages the exhaust valve near TDC and releases the compression event within the cylinder. The compression release actuator is thereafter reset prior to normal exhaust valve motion. As the reset mechanism engages the valve bridge, an internal reset pin (upsetting pin) unseats a pressure maintaining check valve within the reset mechanism, and releases the fluid pressure extending the compression release actuator. The release actuator then returns to its un-extended position, awaiting further activation owing to a renewed or ongoing brake function demand. This series of extend and reset events occurs with each complete camshaft revolution when an engine braking function has been activated.

According to another aspect of the invention, a dual stage hydraulic solenoid valve is provided for use in the hydraulic supply system suitable for supplying lubricating and pressurized oil to control actuation of the above exhaust rocker engine brake system. The dual stage hydraulic solenoid valve includes a valve body having an intake port, an outlet port and an exhaust port, a solenoid coil disposed in the valve body, an armature rectilinearly reciprocating within the solenoid coil, a solenoid pin rectilinearly reciprocating within the valve body and operatively associated with the armature, an intake valve disposed between the intake port and the outlet port. A bypass port is provided such that a portion of the pressurized hydraulic fluid supplied to the valve body through the intake port is regulated to flow through both the outlet port and the exhaust port via the pressure regulating exhaust valve when the solenoid coil is in a de-energized state (i.e., non-braking function state) and, when the solenoid coil is in an energized state (i.e., braking function demand), the pressure regulating exhaust valve is closed and the intake valve is opened to supply pressurized hydraulic fluid only to the outlet port.

Other aspects of the invention, including systems, assemblies, subassemblies, units, engines, processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings.

DETAILED DESCRIPTION OF THE PREFERRED EMBODIMENTS

Figure 1:
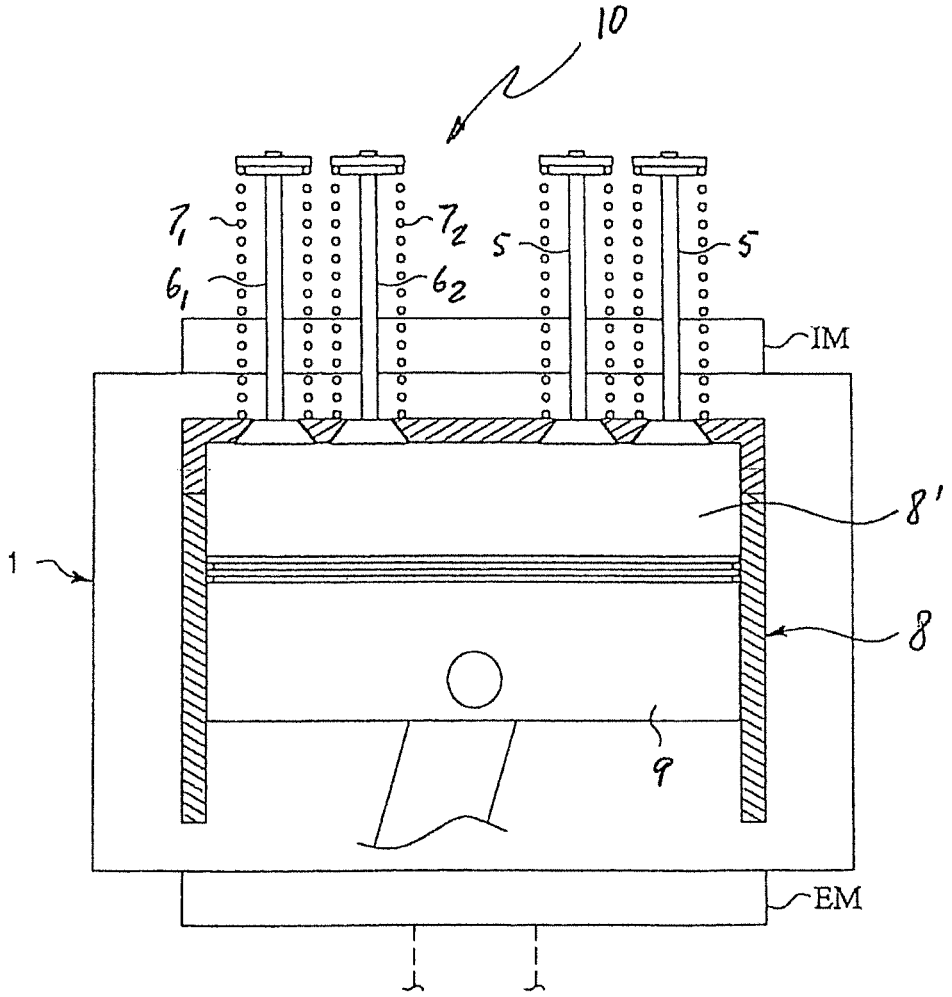
FIG. 1 is a schematic view of an internal combustion engine.

Reference will now be made in detail to an exemplary embodiment and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "upper," "lower," "top," and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the words "a" and/or "an" as used in the claims mean "at least one" and the word "two" as used in the claims means "at least two". For the purpose of clarity, some technical material that is known in the related art has not been described in detail in order to avoid unnecessarily obscuring the disclosure.

FIG. 1 illustrates an internal combustion (IC) engine 1 that may be used with a rocker arm compression-release engine brake system of an exemplary embodiment described herein. The engine 1 typically is a four-stroke diesel engine, comprising a cylinder block 8 including a plurality of cylinders 8'. For the sake of simplicity, only one cylinder 8' is shown in FIG. 1. The other cylinders are identical to the cylinder 8'. Each cylinder 8' is provided with a piston 9 that is reciprocating therein. Each cylinder 8' is also provided with at least one, preferably two intake valves (both labeled with reference numeral 5) and at least one, preferably two (first and second) exhaust valves $\mathbf{6}_1$ and $\mathbf{6}_2$, each provided with a return spring exerting a closing force on the exhaust or intake valve(s) to urge the exhaust or intake valve(s) into the closed position. The return springs of the first and second exhaust valves $\mathbf{6}_1$ and $\mathbf{6}_2$ (also known as exhaust valve springs) are designated by reference numerals $\mathbf{7}_1$ and $\mathbf{7}_2$, respectively. A valvetrain 10 is provided for lifting and closing the intake valves 5 and the exhaust valves $\mathbf{6}_1$ and $\mathbf{6}_2$.

It will be appreciated that each cylinder 8' may be provided with one or more intake valve(s) 5 and one or more exhaust valve(s) 6, although two of each are shown in FIG. 1. The engine 1 also includes an intake manifold IM and an exhaust manifold EM both in fluid communication with the cylinder 8' through the respective intake valves 5 and exhaust valves 6. The IC engine 1 is capable of performing a positive power operation (normal engine cycle) and an engine brake operation (engine brake cycle). The compression-release brake systems operate in a compression brake-on mode during the engine brake operation and a compression brake deactivation (or brake-off) mode during the positive power operation.

FIGS. 2-7 illustrate an exemplary embodiment of the valvetrain 10 of the internal combustion engine 1. The valvetrain 10 includes a conventional intake rocker assembly and an intake valve cam (not shown) for operating two intake valves 5, and a rocker arm compression-release engine brake system 12 according to the exemplary embodiment of the present invention and an exhaust valve cam 2 (shown in FIG. 2), provided for the IC engine 1.

Figure 2:
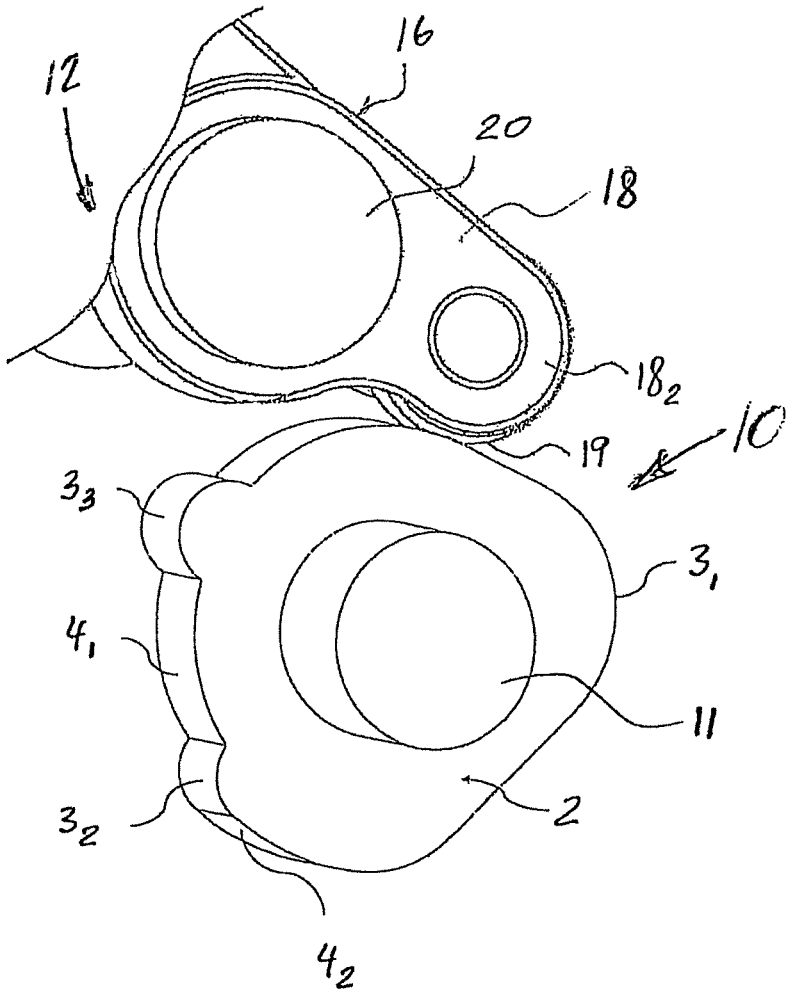
FIG. 2 is a fragmentary perspective view of an exhaust cam shaft and a lost motion exhaust rocker assembly according to the present invention.

The rocker arm compression-release engine brake system 12 according to the exemplary embodiment of the present invention is a lost motion compression-release engine brake system that, as best shown in FIG. 2, is operated by the exhaust valve cam 2. The exhaust valve cam 2 is non-rotatably mounted to a camshaft 11. The exhaust valve cam 2 has a normal (conventional) engine exhaust cam profile $\mathbf{3}_1$, an engine brake lift profile $\mathbf{3}_2$ for the compression-release engine braking event during the engine brake operation, and a pre-charge lift profile $\mathbf{3}_3$ (if present) (as best shown in FIG. 2). The cam lift profiles $\mathbf{3}_1$, $\mathbf{3}_2$ and $\mathbf{3}_3$ are stylized for purposes of explanation. A phase of the exhaust valve cam 2 after the normal exhaust cam profile $\mathbf{3}_1$ and between the pre-charge lift profile $\mathbf{3}_3$ and the engine brake lift profile $\mathbf{3}_2$ that is constant radius is termed a lower base circle $\mathbf{4}_1$. The phase of the exhaust valve cam 2 between the engine brake lift profile $\mathbf{3}_2$ and the normal exhaust cam profile $\mathbf{3}_1$ that is constant radius is termed an upper base circle $\mathbf{4}_2$. The normal engine positive power operation (i.e., the normal engine cycle) incorporates sufficient clearance in the exhaust valve train to eliminate the valve motion that would otherwise be caused by the engine brake lift profile $\mathbf{3}_2$ and the pre-charge lift profile $\mathbf{3}_3$ of the exhaust valve cam 2. Specifically, the normal positive power operation incorporates a greater clearance (lash) in the exhaust valve train than the difference in radii between the upper base circle $\mathbf{4}_2$ and the lower base circle $\mathbf{4}_1$, such that the engine brake lift profile $\mathbf{3}_2$ and the pre-charge lift profile $\mathbf{3}_3$ are not imparted to the exhaust valve(s) $\mathbf{6}_1$ or $\mathbf{6}_2$ during the normal positive power engine operation.

Figure 3:
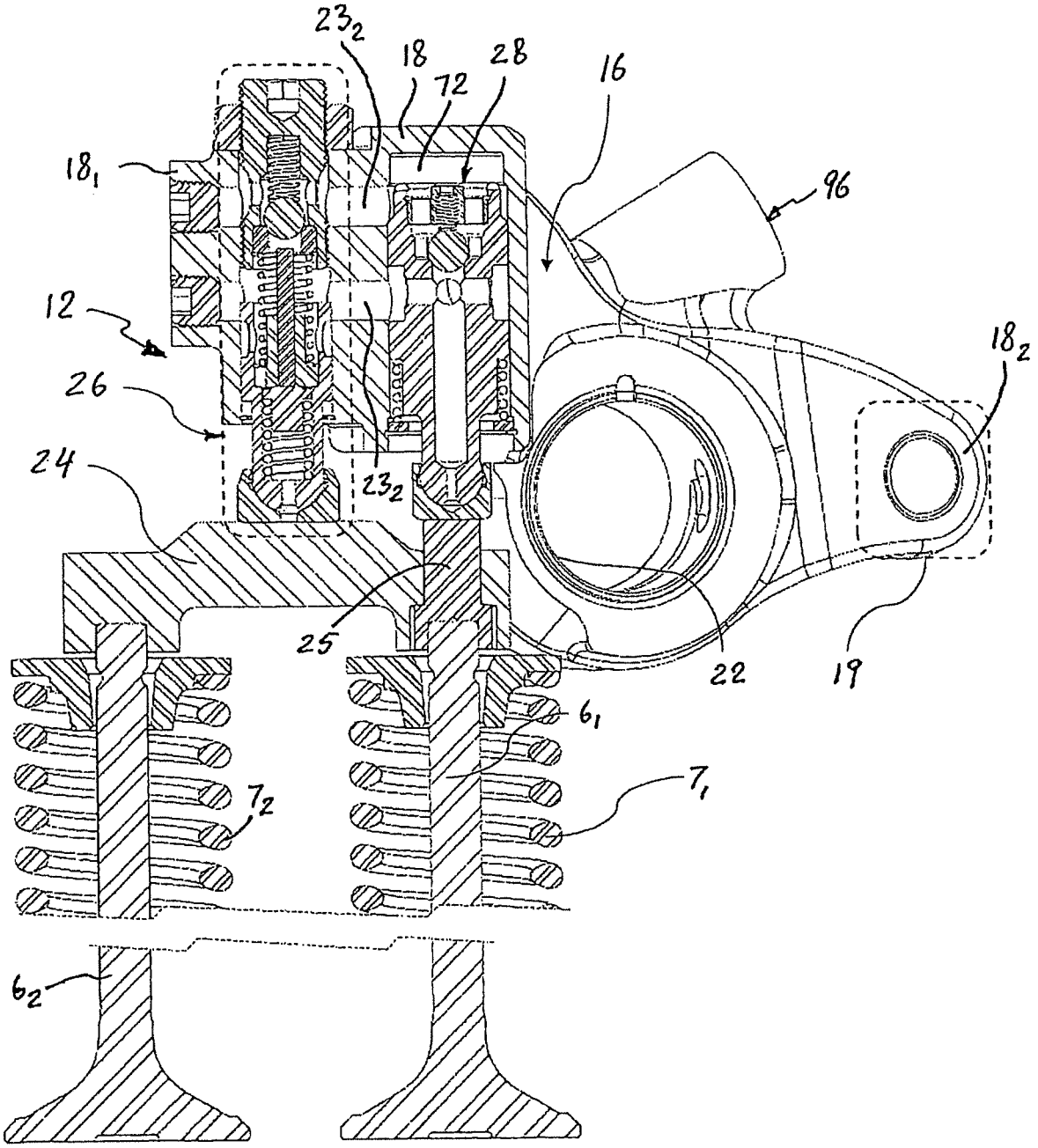
FIG. 3 is a sectional view of a rocker arm compression-release engine brake system with the lost motion exhaust rocker assembly according to a first exemplary embodiment of the present invention in position with respect to a valve bridge in the internal combustion engine.
Figure 4:
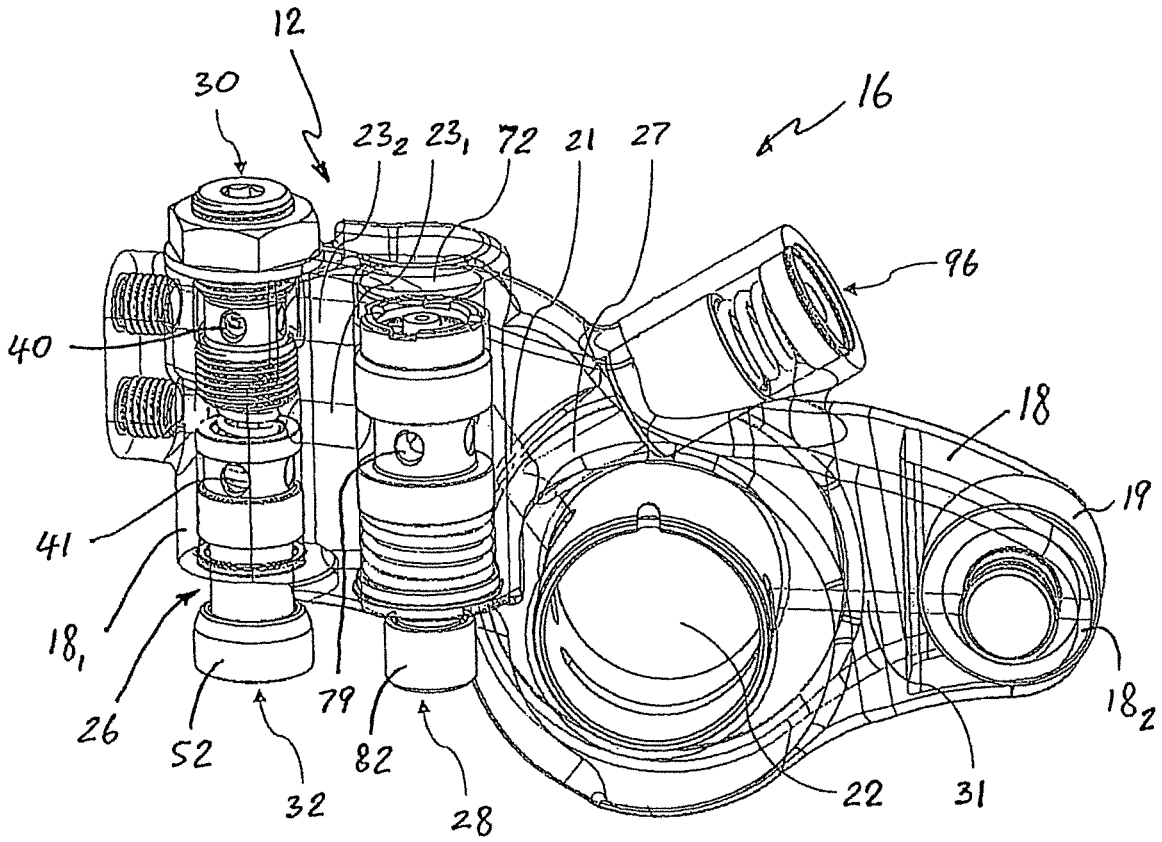
FIG. 4 is a perspective view of the lost motion exhaust rocker assembly including a reset device and an actuation device according to the first exemplary embodiment of the present invention.

The rocker arm compression-release engine brake system 12 according to a first exemplary embodiment of the present invention includes a lost motion exhaust rocker assembly 16 for operating at least one of the first exhaust valve $\mathbf{6}_1$ and the second exhaust valve $\mathbf{6}_2$. The lost motion exhaust rocker assembly 16 according to the first exemplary embodiment of the present invention, shown in FIGS. 3 and 4, is of a lost motion type provided with automatic hydraulic adjusting and resetting functions. The lost motion exhaust rocker assembly 16 comprises an exhaust rocker arm 18 pivotally mounted about a rocker shaft 20 and provided to open the first and second exhaust valves $\mathbf{6}_1$ and $\mathbf{6}_2$ through an exhaust valve bridge 24. The exhaust rocker arm 18 includes a rocker arm bore 22 configured to receive the rocker shaft 20 therethrough so that the exhaust rocker arm 18 is pivotable relative to the rocker shaft 20. Thus, the rocker shaft 20 extends through the rocker arm bore 22 formed in the exhaust rocker arm 18 (as best shown in FIGS. 2, 3 and 4). The rocker shaft 20 allows the exhaust rocker arm 18 to transfer camshaft motion to the exhaust valves $\mathbf{6}_1$ and $\mathbf{6}_2$ through the exhaust valve bridge 24, i.e., moving one or both of the exhaust valves $\mathbf{6}_1$ and $\mathbf{6}_2$ into an open position, which are returned to the closed position by the exhaust valve springs $\mathbf{7}_1$ and $\mathbf{7}_2$. The exhaust valve bridge 24 defines a stop member of the rocker arm compression-release engine brake system 12.

The exhaust rocker arm 18, as best shown in FIGS. 3 and 4, has two ends: a driving (first distal) end $\mathbf{18}_1$ controlling the engine exhaust valves $\mathbf{6}_1$ and $\mathbf{6}_2$, and a driven (second distal) end $\mathbf{18}_2$ adapted to contact the exhaust valve cam 2. Specifically, the lost motion exhaust rocker assembly 16 includes an exhaust cam follower 19 mounted to the driven end $\mathbf{18}_2$ of the exhaust rocker arm 18, as best shown in FIGS. 2-4. According to the exemplary embodiment of the present invention, the exhaust cam follower 19 is in the form of, for example, a cylindrical roller rotatably mounted to the driven end $\mathbf{18}_2$ of the exhaust rocker arm 18. The exhaust cam follower 19 is adapted to contact the exhaust cam profile $\mathbf{3}_1$, the engine brake lift profile $\mathbf{3}_2$ and the pre-charge lift profile $\mathbf{3}_3$ of the exhaust valve cam 2. The exhaust cam follower 19 defines a camshaft interface. Alternatively, the camshaft interface can be adapted to suit engine requirements, for example with a ball or socket for a push-rod type interface.

The lost motion exhaust rocker assembly 16 further comprises a reset device 26 and an actuation device 28 disposed in the exhaust rocker arm 18. The reset device 26 is positioned above the exhaust valve bridge 24, and is configured to drive the exhaust valve bridge 24 during positive power operation, i.e., normal exhaust valve operation. Moreover, the exhaust rocker arm 18 has a supply conduit 21, a connecting conduit $\mathbf{23}_1$ and a reset conduit 232, all formed within the exhaust rocker arm 18. The supply conduit 21 fluidly connects a source 156 of pressurized hydraulic fluid (e.g., motor oil) (best shown in FIG. 10), disposed outside the exhaust rocker arm 18, to the actuation device 28. The connecting conduit $\mathbf{23}_1$ and the reset conduit 232 are two separate channels, spaced from each other and fluidly interconnecting the reset device 26 and the actuation device 28.

Figure 5:
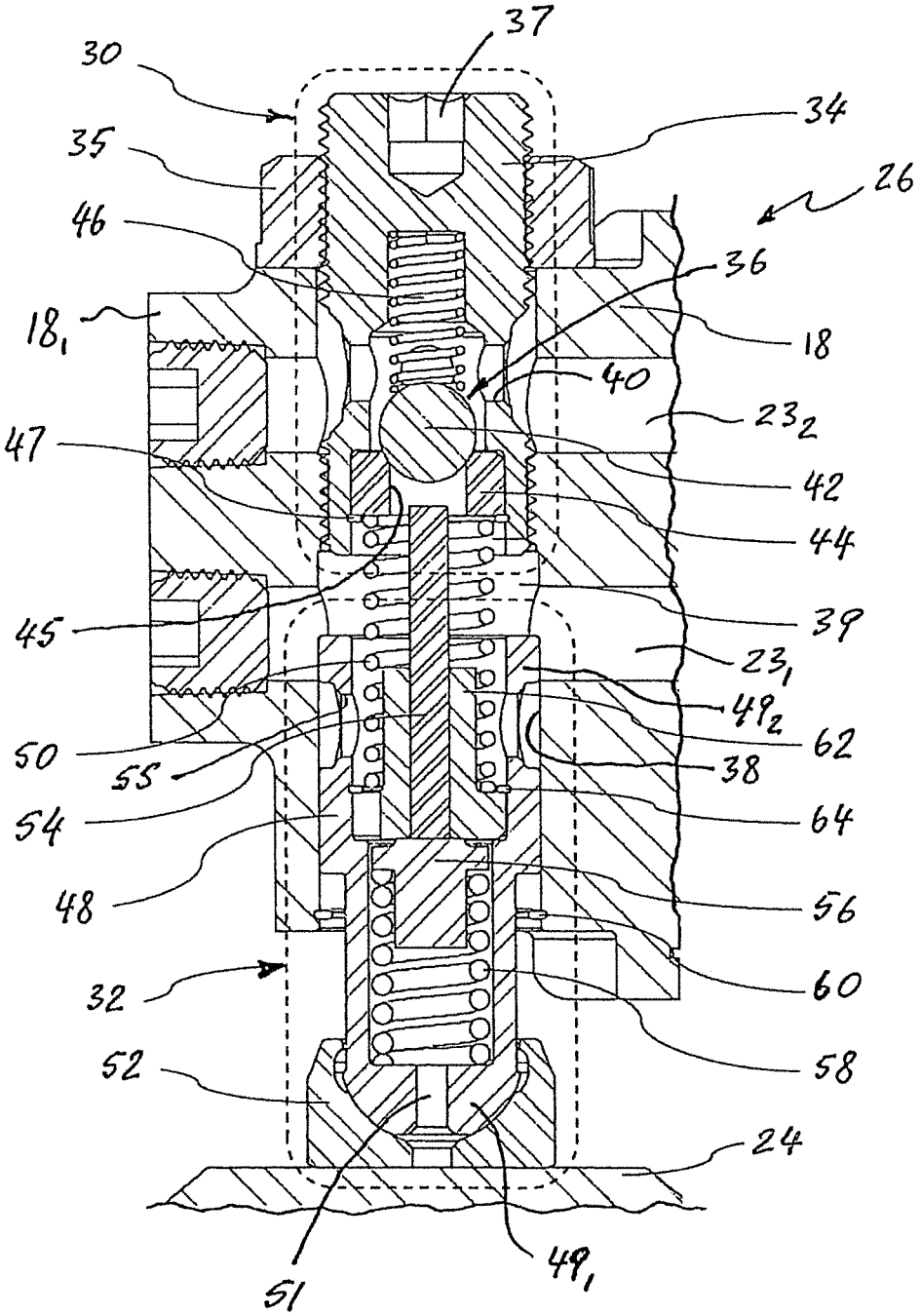
FIG. 5 is a sectional view of the reset device according to the first exemplary embodiment of the present invention.

The reset device 26, as best shown in FIGS. 4 and 5, comprises an adjuster assembly 30 and a slider assembly 32. The cylindrical reset bore 38, slider assembly 32, and adjuster assembly 30 define a reset cavity 39, within the exhaust rocker arm 18, fluidly connected with the connecting conduit $\mathbf{23}_1$. The adjuster assembly 30 includes an adjuster body 34, and a reset check valve 36 disposed within the adjuster body 34. According to the first exemplary embodiment of the present invention, the adjuster body 34 is entirely threaded, as best illustrated in FIG. 5. The adjuster body 34 is threadedly and adjustably disposed within the cylindrical reset bore 38 formed in the exhaust rocker arm 18 to provide normal exhaust valve lash adjustment. The adjuster body 34 of the adjuster assembly 30 is provided with a socket, such as hexagonal socket 37, accessible from above the exhaust rocker arm 18 for adjusting the position of the adjuster body 34 of the reset device 26 The adjuster assembly 30 is locked in position by an adjuster nut 35, as best shown in FIG. 5.

The reset check valve 36 comprises a ball-valve member 42, a check-valve seat 44, and a ball-check spring 46, all disposed within the adjuster body 34 so that the ball-valve member 42 is disposed between the check-valve seat 44 and the ball-check spring 46. The ball-valve member 42 is urged toward the ball-check seat 44 by the biasing spring force of the ball-check spring 46. The ball-valve member 42, the ball-check seat 44, and the ball-check spring 46 define a reset check valve 36 normally biased closed (i.e., into a closed position) by the ball-check spring 46. The check-valve seat 44 has a central opening 45 therethrough, as best shown in FIG. 5. The check-valve seat 44 is retained within the adjuster body 34 by a first retaining ring 47, such as a C-ring, known in the art. In other words, the ball-valve member 42 closes and opens the central opening 45 through the ball-check seat 44 of the reset check valve 36 so as to selectively fluidly connect the connecting conduit $\mathbf{23}_1$ with the reset cavity 39.

The adjuster body 34 is provided with one or more (i.e., at least one) supply ports 40. The supply ports 40 are disposed above the ball-valve member 42 of the reset check valve 36 so as to fluidly connect the reset cavity 39 of the reset bore 38 with the reset conduit 232 when the reset check valve 36 is in the open position.

The slider assembly 32 comprises a slider-piston 48 configured to rectilinearly reciprocate within the reset cavity 39 of the exhaust rocker arm 18, and a slider bias spring 50 disposed between the slider-piston 48 and the check-valve seat 44 for biasing the slider-piston 48 in a direction away from the adjuster assembly 30. Moreover, slider bias spring 50 is slidably disposed within the reset bore 38 of the exhaust rocker arm 18 and partially within the slider-piston 48, as best shown in FIG. 5. The slider-piston 48 has an elongated distal end $\mathbf{49}_1$ adjacent to the exhaust valve bridge 24, and a proximal end 492 facing the check-valve seat 44. The slider-piston 48 is provided with one or more (i.e., at least one) piston ports 55. The piston ports 55 are disposed below the ball-valve member 42 of the reset check valve 36 so as to maintain fluid connection of the reset cavity 39 of the reset bore 38 with the connecting conduit $\mathbf{23}_1$ for all positions of the slider-piston 48.

As best shown in FIG. 5, the elongated distal end $\mathbf{49}_1$ of the slider-piston 48 at least partially extends from the reset bore 38 of the exhaust rocker arm 18. The slider-piston 48 is movable relative to the exhaust rocker arm 18 between an extended position, and a retracted position. The slider-piston 48 is provided with a contacting (so called "elephant") foot 52 mounted so as to swivel on the distal end $\mathbf{49}_1$ of the slider-piston 48 adjacent to the exhaust valve bridge 24. A lubricating port 51 through the distal end $\mathbf{49}_1$ of the slider-piston 48 provides lubricating oil to the contacting foot 52 and the exhaust valve bridge 24.

The slider-piston 48 is urged by hydraulic pressure in the reset cavity 39 and by the slider bias spring 50 away from the adjuster assembly 30 so as to maintain contact of the contacting foot 52 with the exhaust valve bridge 24 during all engine operation (brake on or off). In other words, the slider-piston 48 and the slider bias spring 50 of the slider assembly 32 provide an active lash adjuster to absorb the large amount of lost motion between the exhaust rocker assembly 16 and the exhaust valve bridge 24 when the compression-release engine brake system 12 is in the brake-off mode. A second retaining ring 60, such as a C-ring, prevents the slider-piston 48 from fully ejecting from the reset bore 38 in the exhaust rocker arm 18, allowing ease of assembly and maintenance.

The reset device 26 further comprises an upsetting pin 54 configured to rectilinearly reciprocate within the reset bore 38 of the exhaust rocker arm 18. The upsetting pin 54 is configured to contact, lift and hold the ball-valve member 42 of the reset check valve 36 off the ball-check seat 44. An upper end of the upsetting pin 54 is disposed adjacent to the ball-valve member 42, while a lower end of the upsetting pin 54 engages the slider-piston 48 through a reset spring cap 56 and a reset pressure control spring 58 disposed inside the slider-piston 48 between the distal end $\mathbf{49}_1$ thereof and the reset spring cap 56. The reset pressure control spring 58 is configured to lift, through the resilient biasing action of the reset pressure control spring 58, the upsetting pin 54.

As best illustrated in FIG. 5, the upsetting pin 54 extends through pin guide 62 supporting and guiding the reciprocating, rectilinear movement of the upsetting pin 54. The upsetting pin 54 also interacts with the reset pressure control spring 58 via the reset spring cap 56. The pin guide 62 is retained by a third retaining ring 64, such as a C-ring, within the slider-piston 48.

The adjuster assembly 30 provides an adjustable retraction limit for the slider assembly 32 so as to establish a permanent lash between the exhaust valve bridge 24 (i.e., the stop member) and the slider-piston 48 when in the retracted position. The slider-piston 48 of the reset device 26 is configured to drive the exhaust valve bridge 24 during normal exhaust valve motion. The clearance between the upsetting pin 54 and the ball valve member 42 when the slider assembly 32 is fully extended is also determined by the exhaust valve bridge lash, thereby incorporating engine brake lash and normal exhaust valve lash into a single adjustment.

Figure 6:
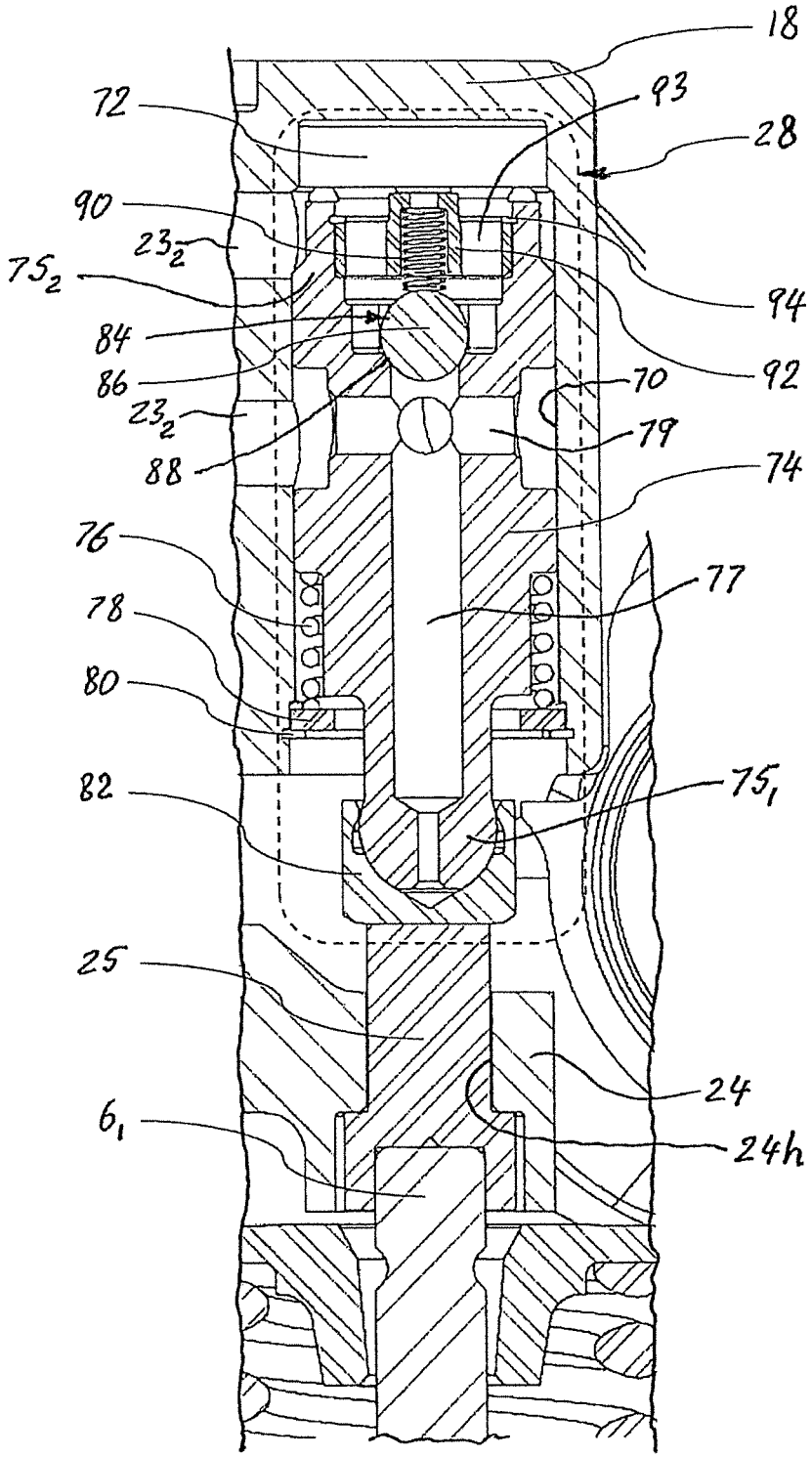
FIG. 6 is a sectional view of the actuation device according to the first exemplary embodiment of the present invention.

FIG. 6 shows the details of the compression release actuation device 28 disposed in another cylindrical actuation bore 70 also formed in the exhaust rocker arm 18 and spaced from the cylindrical reset bore 38. The actuation device 28 comprises an actuation piston 74 configured to rectilinearly reciprocate within the cylindrical actuation bore 70 of the exhaust rocker arm 18, and an actuation piston return spring 76 mounted around the actuation piston 74 for biasing the actuation piston 74 in a direction away from the first exhaust valve $\mathbf{6}_1$, also called a brake valve. The cylindrical actuation bore 70 defines an actuation cavity 72 delimited by the actuation piston 74 within the exhaust rocker arm 18 above the actuation piston 74. Hydraulic pressure in the actuation cavity 72 above the actuation piston 74 extends the actuation piston 74 toward the brake valve $\mathbf{6}_1$.

The actuation piston 74 is moveable between retracted and extended positions relative to the actuation bore 70 and is adapted to contact a top end surface of a single-valve actuation pin 25 (best shown in FIGS. 3 and 6). The single-valve actuation pin 25 is slidably movable relative to the exhaust valve bridge 24 through an opening **24*h* in the exhaust valve bridge 24 (best shown in FIG. 6). The actuation device 28 further comprises a support washer 78 that provides an extension limiter for the actuation piston 74 and supports the actuation piston return spring 76 around the actuation piston 74. The support washer 78 is retained within the actuation bore 70 by a fourth retaining ring 80**, such as a C-ring.

The actuation piston 74 is provided with a piston contacting (so called "elephant") foot 82 mounted so as to swivel on a lower end $\mathbf{75}_1$ of the actuation piston 74 adjacent to the single-valve actuation pin 25 of the exhaust valve bridge 24. The piston contacting foot 82 interacts with the exhaust brake valve $\mathbf{6}_1$ only via the single-valve actuation pin 25 of the exhaust valve bridge 24. The exhaust single-valve actuation pin 25 allows the actuation piston 74 to apply sufficient pressing force against the first exhaust valve $\mathbf{6}_1$ to open only the first exhaust valve $\mathbf{6}_1$ (only one of the two exhaust valves $\mathbf{6}_1$ and $\mathbf{6}_2$) during the compression-release engine braking operation (i.e., in the brake-on mode). In other words, the single-valve actuation pin 25 is reciprocatingly movable relative to the exhaust valve bridge 24 so as to make the first exhaust valve $\mathbf{6}_1$ movable relative to the second exhaust valve $\mathbf{6}_2$ and the exhaust valve bridge 24. Therefore, the lost motion compression-release engine brake system 12 according to the exemplary embodiment of the present invention opens only one of two exhaust valves during an engine compression-release event, and resets the one exhaust valve prior to a normal exhaust stroke valve motion. Thus, the actuation piston 74 is configured to be operatively associated with a first exhaust valve $\mathbf{6}_1$ to only permit opening of the first exhaust valve $\mathbf{6}_1$. Moreover, the actuation piston 74 is operatively associated with the reset device 26 through the connecting conduit $\mathbf{23}_1$ and the reset conduit $\mathbf{23}_2$ of the exhaust rocker arm 18.

The actuation device 28 further comprises an actuation piston check valve 84 disposed within the actuation piston 74. The actuation piston check valve 84 includes a ball-valve member 86, which seats on a check-valve seat 88 formed in the actuation piston 74. The actuation piston check valve 84 is configured to move between a closed position and an open position to provide a unidirectional hydraulic fluid flow pathway through the actuation piston 74 to the actuation cavity 72 in the exhaust rocker arm 18 above the actuation piston 74. An actuation piston check spring 90 biases the ball-valve member 86 into the closed position of the actuation piston check valve 84.

The actuation piston 74 is provided with a fluid conduit 77 extending between an upper end $\mathbf{75}_2$ and the lower end $\mathbf{75}_1$ of the actuation piston 74, and one or more (i.e., at least one) actuator ports 79 therethrough formed for fluidly connecting the fluid conduit 77 of the actuation piston 74 with the supply conduit 21 and the connecting conduit $\mathbf{23}_1$.

A piston cap 92 and the actuation piston check spring 90 are retained in the actuation piston 74 by a fifth retaining ring 94, such as a C-ring. The piston cap 92 is provided with one or more openings 93 fluidly connecting the actuation cavity 72, and thus the reset conduit $\mathbf{23}_2$, with the actuator ports 79 of the actuation piston 74, and the supply conduit 21 and the connecting conduit $\mathbf{23}_1$, through the actuation piston check valve 84. In other words, the check valve 84 selectively fluidly connects and disconnects the reset conduit $\mathbf{23}_2$ with the connecting conduit $\mathbf{23}_1$ and the supply conduit 21. Thus, the reset device 26 is operatively connected to the actuation device 28 through the connecting conduit $\mathbf{23}_1$ and the reset conduit $\mathbf{23}_2$ of the exhaust rocker arm 18.

Figure 7:
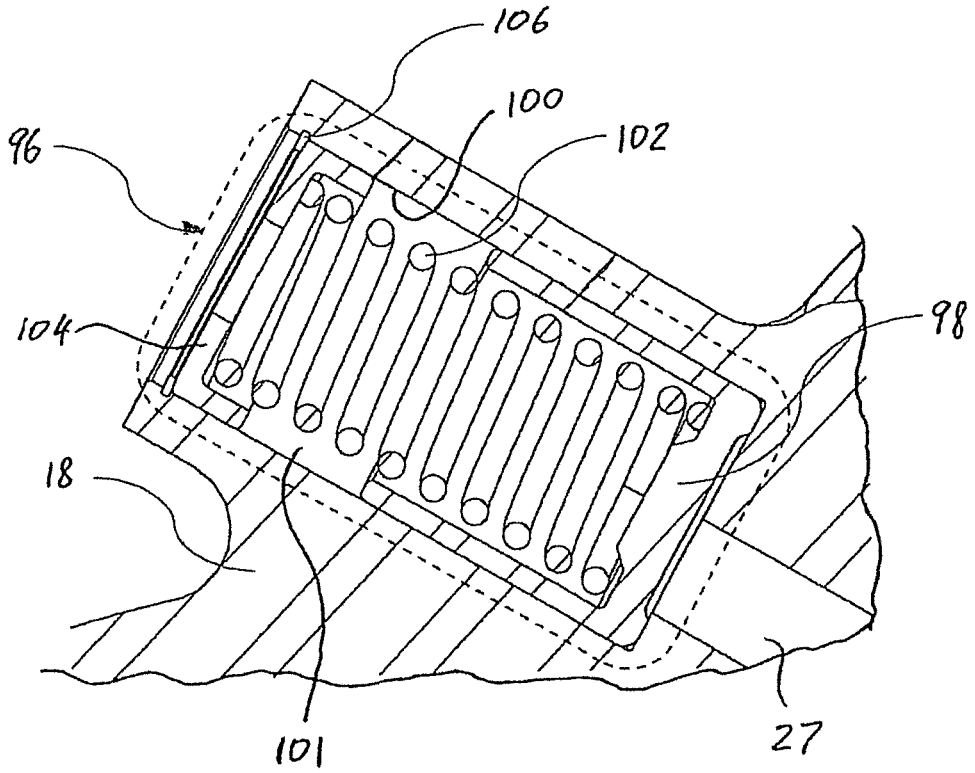
FIG. 7 is a sectional view of an integrated accumulator assembly of the lost motion exhaust rocker assembly according to the first exemplary embodiment of the present invention.

The exhaust rocker assembly 16 according to the first exemplary embodiment of the present invention further comprises an optional integrated accumulator assembly 96 integrated in the exhaust rocker arm 18, as best shown in FIG. 7. The optional accumulator assembly 96 includes an accumulator piston 98 disposed in a substantially cylindrical accumulator bore 100 in the exhaust rocker arm 18, an accumulator pressure control spring 102 biasing the accumulator piston 98 into the exhaust rocker arm 18, and an accumulator cap 104, which acts as an extension limiter for the accumulator piston 98 and is retained in the exhaust rocker arm 18 by a sixth retaining ring 106, such as a C-ring.

The cylindrical accumulator bore 100 defines an accumulator cavity 101 within the exhaust rocker arm 18. The accumulator piston 98 is configured to rectilinearly reciprocate within the accumulator cavity 101. The accumulator cavity 101 disposed below the accumulator piston 98 is fluidly connected with an accumulator conduit 27 (best shown in FIGS. 4 and 7). In turn, the accumulator conduit 27 is fluidly connected with the supply conduit 21, as best shown in FIG. 4. Hydraulic pressure of the pressurized hydraulic fluid, supplied to the accumulator cavity 101 below the accumulator piston 98 through the accumulator conduit 27, displaces the accumulator piston 98 towards the accumulator cap 104. The accumulator pressure control spring 102 biases the accumulator piston 98 such that the hydraulic fluid discharged from the actuation cavity 72 is stored within the lost motion exhaust rocker assembly 16 at a sufficient pressure to refill the actuation cavity 72 on a subsequent engine cycle. When the optional accumulator is not present, rapid actuation of the brake-on/brake-off hydraulic fluid function is provided remotely, from another local accumulator type device, or pumps/valves, via pressurized fluid through conduit 21.

FIG. 4 illustrates hydraulic connections within the exhaust rocker arm 18. A continuous hydraulic fluid circuit within the exhaust rocker arm 18 is created as the pressurized hydraulic fluid enters through the rocker arm bore 22 into the supply conduit 21, the connecting conduit $\mathbf{23}_1$, the accumulator conduit 27, the accumulator cavity 101, the actuation device 28, and the reset cavity 39. The pressurized hydraulic fluid moves through the actuation device 28 and the adjuster assembly 30 into the actuation cavity 72 and the reset conduit $\mathbf{23}_2$, which creates the capability to trap the hydraulic fluid between the reset check valve 36 and the actuation piston check valve 84 within the actuation device 28 and the adjuster assembly 30. A force attempting to retract the actuation piston 74 can be supported by an increase in hydraulic pressure between the reset check valve 36 and the actuation piston check valve 84. A lubrication conduit 31 can be integrated into or segregated from the hydraulic fluid circuit within the exhaust rocker arm 18, depending on hydraulic fluid pressure requirements.

Figure 8:
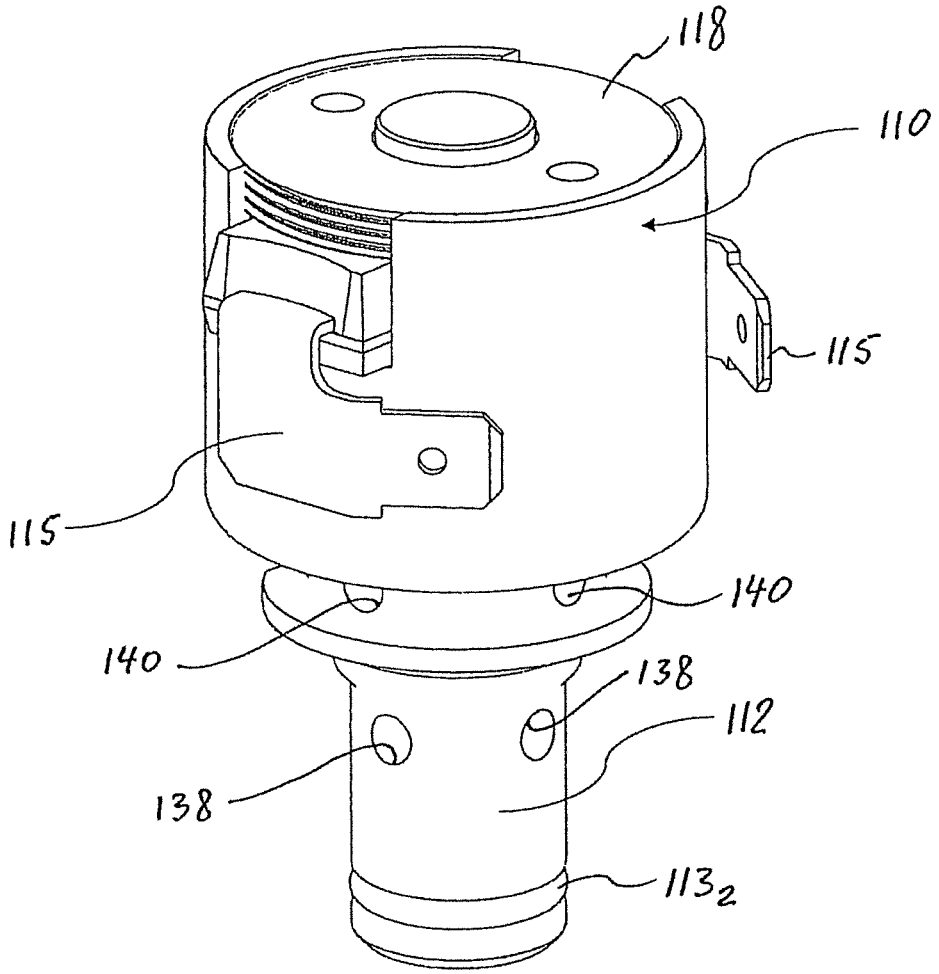
FIG. 8 is a perspective view of a solenoid valve of the rocker arm compression-release engine brake system according to the first exemplary embodiment of the present invention.

FIG. 8 shows a dual stage hydraulic solenoid valve 110 suitable for controlling a "brake-on/brake-off" pressurized fluid supply to an engine brake rocker system in accordance with the present invention as described above. The dual stage hydraulic solenoid valve 110 includes a valve body 112, a solenoid coil 114 disposed in the valve body 112, an armature 116 rectilinearly reciprocating within the solenoid coil 114, and contacts (or terminals) 115 that connect the solenoid coil 114 with a source of an electric power to activate the dual stage hydraulic solenoid valve 110.

Figure 9:
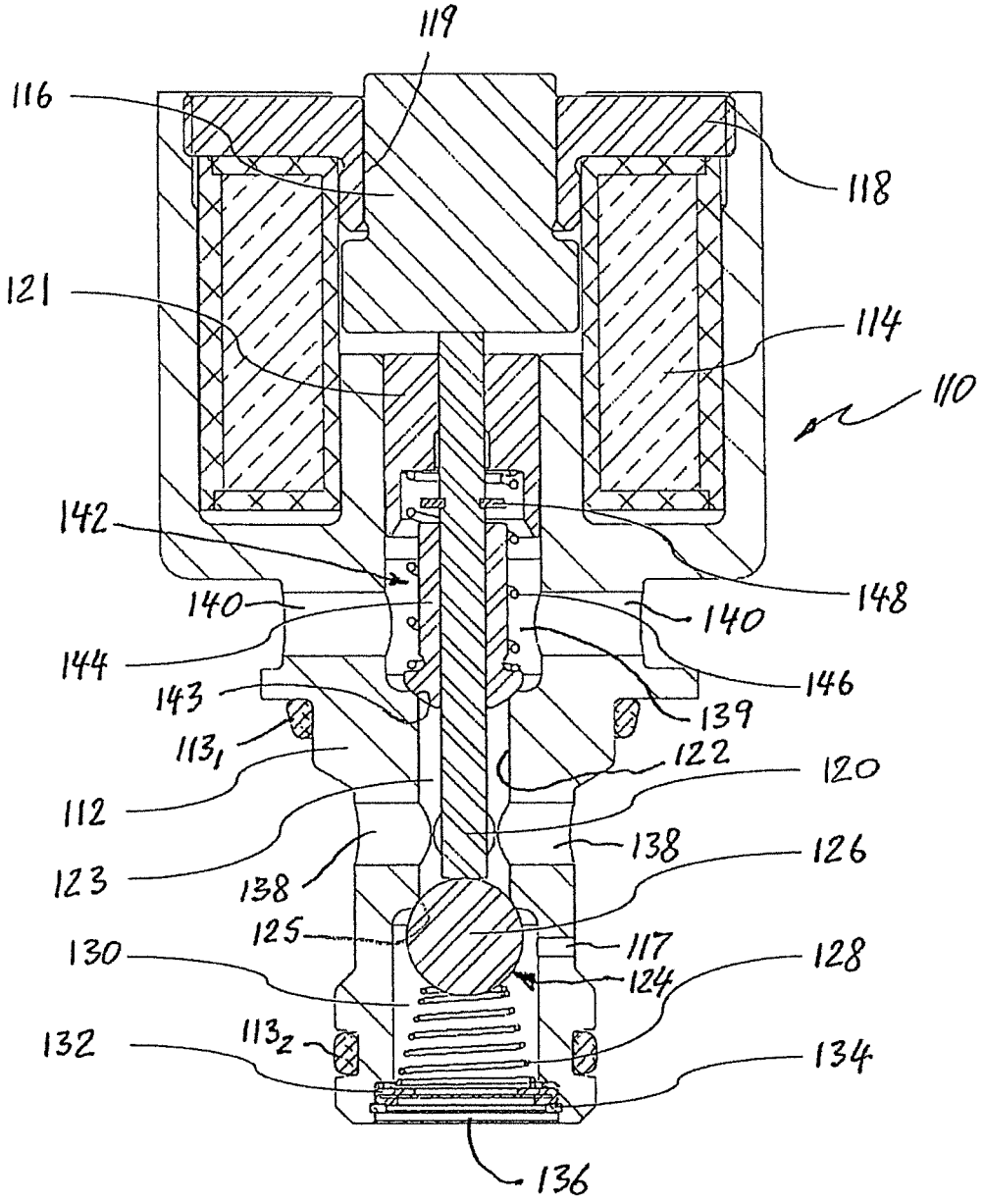
FIG. 9 is a sectional view of the solenoid valve of FIG. 8.

FIG. 9 shows a sectional view of the dual stage hydraulic solenoid valve 110 shown in FIG. 8. The armature 116 and the solenoid coil 114 are retained in the valve body 112 by a cap 118, which is fixed (i.e., non-moveably attached) to the valve body 112 by appropriate means, such as a threaded connection. The dual stage hydraulic solenoid valve 110 further includes a solenoid pin 120 and an intake valve 124 disposed in an inlet cavity 130 formed within a distal end of the valve body 112, which is opposite to the cap 118 of the dual stage solenoid valve 110, as best shown in FIG. 9. As also best shown in FIG. 9, the valve body 112 is provided with an upper seal $\mathbf{113}_1$ and a lower seal $\mathbf{113}_2$, both in the form of an O-ring.

The armature 116 rectilinearly reciprocates within the solenoid coil 114 and bore 119 in the cap 118 to selectively engage the solenoid pin 120. The solenoid pin 120 is rectilinearly moveable within bore 113 through the valve body 112 and through a pin guide 121, which is disposed inside the bore 122 of the valve body 112 and is fixed to the valve body 112 by appropriate means, such as press fit. The solenoid pin 120 is disposed within the bore 122 of the valve body 112 to selectively open the intake valve 124. The bore 122 of the valve body 112 forms an outlet cavity 123 within the valve body 112. As best shown in FIG. 9, the outlet cavity 123 is fluidly connected to the inlet cavity 130 within the distal end of the valve body 112.

The intake valve 124 includes a valve member in the form of an inlet ball 126 biased towards an intake valve seat 125, formed in the valve body 112, by an inlet spring 128 and by the pressurized hydraulic fluid in the inlet cavity 130. In other words, the inlet spring 128 biases the inlet ball 126 towards the closed position of the intake valve 124. The inlet spring 128 is retained within the valve body 112 by an inlet screen 132, which also serves as a screen (or plate type) filter of the hydraulic fluid, and a retaining ring 134, such as a C-ring. Thus, the inlet ball 126 of the intake valve 124 is moveable between the closed position of the intake valve 124 when the inlet ball 126 is in contact with the intake valve seat 125, and an open position of the intake valve 124 when the inlet ball 126 is spaced from the intake valve seat 125 to allow fluid communication between the outlet cavity 123 and the inlet cavity 130.

The valve body 112 of the dual stage solenoid valve 110 also includes an intake port 136, an outlet port 138 in fluid communication with the outlet cavity 123, and an exhaust port(s) 140 in fluid communication with an exhaust cavity 139. The intake port 136 is formed at the distal end of the valve body 112 and connected to the source 156 of pressurized hydraulic fluid. The intake valve 124 is disposed between the intake cavity 130 and the outlet cavity 123.

The dual stage solenoid valve 110 further includes a pressure regulating exhaust valve 142 disposed in the outlet cavity 123 within the valve body 112 between the outlet cavity 123 and the exhaust cavity 139, as best shown in FIG. 9. The pressure regulating exhaust valve 142 includes an exhaust plug 144 rectilinearly moveable toward and away from an exhaust valve seat 143 formed in the valve body 112. The solenoid pin 120 passes through the exhaust plug 144, and the exhaust plug 144 moves along the solenoid pin 120. The exhaust plug 144 is biased toward the exhaust valve seat 143 by an exhaust spring 146, and is configured to be displaced away from the exhaust valve seat 143 by the pressurized hydraulic fluid in the outlet cavity 123, so as to form a pressure regulating exhaust valve 142. In other words, the pressure regulating exhaust valve 142 opens when pressure in the outlet cavity 123 generates a force on the exhaust plug 144 higher than the resilient force of the exhaust spring 146. Thus, the exhaust plug 144 of the pressure regulating exhaust valve 142 is moveable between a closed position when the exhaust plug 144 is in contact with the exhaust valve seat 143, and an open position when the exhaust plug 144 is spaced from the exhaust valve seat 143 to allow fluid communication between the exhaust cavity 139 and the outlet cavity 130.

The solenoid valve 110 further includes an exhaust plug retainer in the form of an exhaust plug circlip (or C-clip) 148 attached to the solenoid pin 120. The exhaust plug circlip 148 is driven by the solenoid pin 120 against the exhaust plug 144 to increase the holding force against the exhaust valve seat 143, thus allowing an increase of the hydraulic fluid pressure in the outlet cavity 123.

As illustrated in FIG. 9, the solenoid pin 120 is disposed between the armature 116 and the inlet ball 126 to selectively engage the inlet ball 126 and move the inlet ball 126 away from the valve seat 125 toward the open position of the intake valve 124. Specifically, when the solenoid coil 114 of the solenoid valve 110 is de-energized (i.e., in a de-energized state), the inlet spring 128 and the pressurized hydraulic fluid in the inlet cavity 130 bias the inlet ball 126 toward the closed position of the intake valve 124. However, when the solenoid coil 114 of the solenoid valve 110 is energized (i.e., in an energized state), the armature 116 moves downwardly toward the intake valve 124 and pushes the solenoid pin 120 downward, which, in turn, displaces the inlet ball 126 away from the intake valve seat 125 toward the open position, and thus opening fluid communication between the outlet cavity 123 and the inlet cavity 130.

Figure 10:
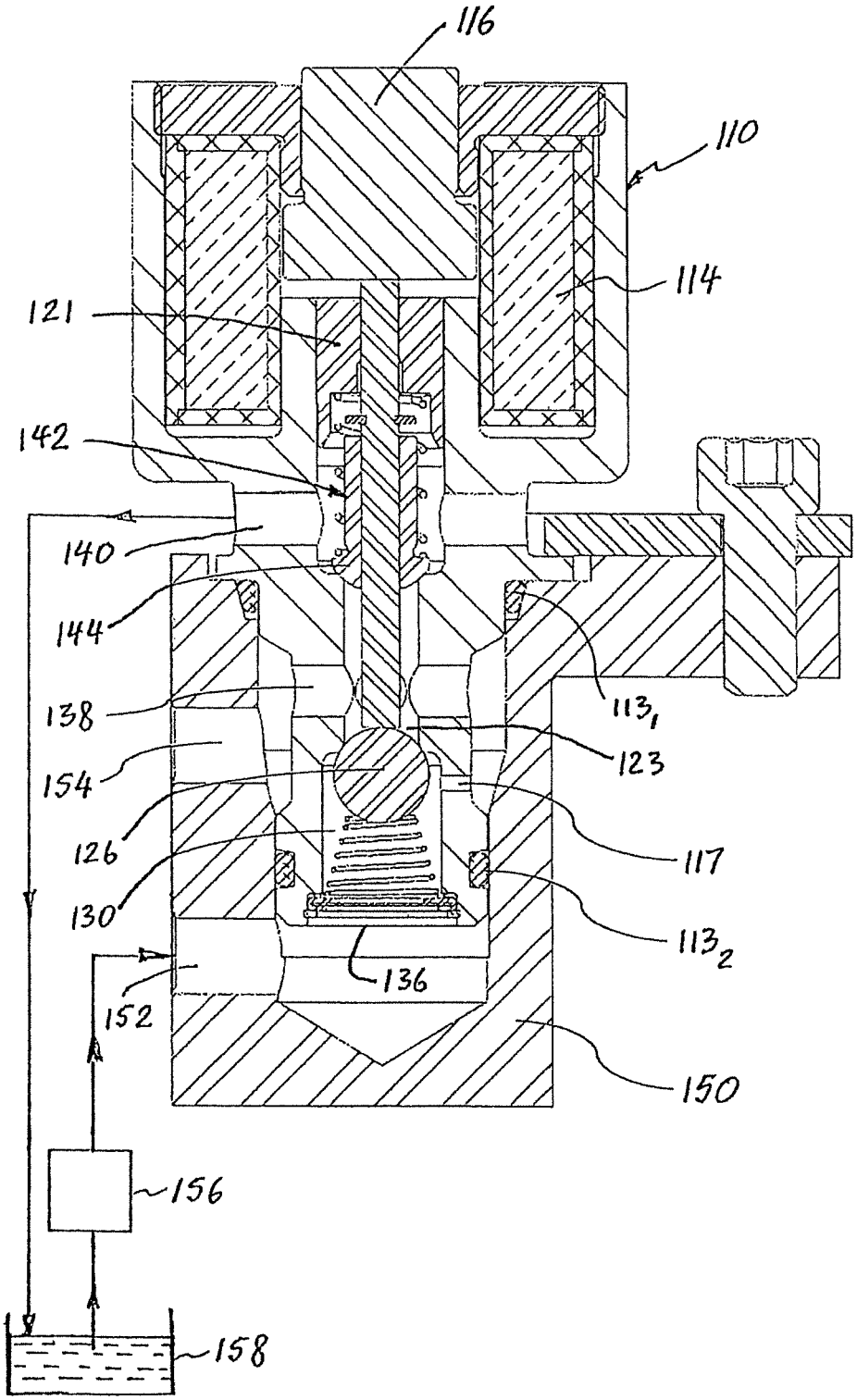
FIG. 10 is a sectional view of solenoid valve of FIG. 8 installed in a hydraulic manifold.

FIG. 10 shows an exemplary installation of the solenoid valve 110 of FIG. 8 mounted to a hydraulic manifold 150. Specifically, a distal end of the valve body 112 is disposed within the hydraulic manifold 150 through the upper seal $\mathbf{113}_1$ and the lower seal $\mathbf{113}_2$ so as to seal the solenoid valve 110 to the surrounding hydraulic manifold 150. The hydraulic fluid flows into the inlet cavity 130 from an inlet port 152 of the hydraulic manifold 150 and is prevented from entering the outlet cavity 123 of the solenoid valve 110 by the inlet ball 126 and the lower seal $\mathbf{113}_2$. The inlet port 152 of the hydraulic manifold 150 is fluidly connected to the source 156 of the pressurized hydraulic fluid. The source 156 of the pressurized hydraulic fluid, according to the exemplary embodiment, is in the form of a hydraulic fluid pump, such as an engine oil pump of the diesel engine 1. Correspondingly, in the exemplary embodiment, engine lubricating oil is used as the working hydraulic fluid stored in a hydraulic fluid sump 158, best shown in FIG. 10. It will be appreciated that other appropriate sources of the pressurized hydraulic fluid and any other appropriate type of fluid will be within the scope of the present invention.

A bypass port 117 in the valve body 112 is associated with the intake valve 124 and allows a portion of the hydraulic fluid to move into the outlet cavity 123 while the inlet ball 126 of the intake valve 124 is in the closed position. The hydraulic fluid is prevented from flowing from the outlet cavity 123 through the exhaust cavity 139 to exhaust port 140 by the exhaust plug 144 of the pressure regulating exhaust valve 142 and by the upper seal $\mathbf{113}_1$ until the exhaust plug 144 moves away from the exhaust valve seat 143. The outlet cavity 123 is fluidly connected to the outlet port 138 which supplies the pressurized hydraulic fluid to downstream components, such as the supply conduit 21 and the accumulator conduit 27 of the exhaust rocker assembly 16, through an outlet port 154 of the hydraulic manifold 150. The exhaust cavity 139 is fluidly connected to the hydraulic fluid sump 158, by the exhaust port 140, as best shown in FIG. 10. In other words, the hydraulic fluid (such as motor oil) returns (drains back) to the hydraulic fluid sump 158 from the exhaust cavity 139 above the exhaust plug 144 through the exhaust port(s) 140.

The dual stage solenoid valve 110 is configured to provide two stages of hydraulic pressure in the outlet cavity 123 of the solenoid valve 110: a low pressure stage and a full inlet (or high) pressure stage. The two stages of hydraulic pressure in the outlet cavity 123 of the solenoid valve 110 are controlled by an inlet pressure generated by the source 156 of the pressurized hydraulic fluid, the size of the bypass port 117 in the valve body 112, and the force exerted by the exhaust spring 146 on the exhaust plug 144. In the low pressure stage, the solenoid coil 114 is de-energized (not energized), the inlet ball 126 is seated on the intake valve seat 125 of the valve body 112 (i.e., in the closed position) and the pressurized hydraulic fluid in the outlet cavity 123 is delivered by the bypass port 117, thus providing a low (or first) inlet pressure hydraulic fluid. The hydraulic pressure in the outlet cavity 123 is regulated by the elastic force of the exhaust spring 146 on the exhaust plug 144. The by-pass port 117 is configured to provide sufficient flow of the pressurized hydraulic fluid to satisfy downstream requirements, while preventing an excess of the hydraulic fluid flow from being exhausted and causing a decrease in the inlet pressure. When the solenoid coil 114 is energized (i.e., when electrical power is supplied to the electrical contacts 115), an electromagnetic force displaces the armature 116 toward the solenoid pin 120, driving the exhaust plug retainer 148 toward the exhaust plug 144 and upsetting the inlet ball 126 from the intake valve seat 125 of the valve body 112 (i.e., to the open position). This increases a seating force on the exhaust plug 144 to a force that the inlet pressure is unable to overcome (thus, retaining the pressure regulating exhaust valve 142 in the closed position), allowing for the high pressure stage in the outlet cavity 123, thus providing a full (or second) inlet pressure hydraulic fluid. The full (or second) inlet pressure of the hydraulic fluid is higher than the low (or first) inlet pressure of the hydraulic fluid.

In operation in the brake system, the pressurized hydraulic fluid is continuously provided by the dual stage solenoid valve 110 to the reset cavity 39 of the reset device 26 of the exhaust rocker arm 18 at a pressure lower than that which would extend the actuation piston 74. The engine brake activation is effected by switching the solenoid valve 110 to increase the pressure of the hydraulic fluid in the exhaust rocker assembly 16 above the hydraulic pressure necessary to extend the actuation piston 74 against the bias force of the actuation piston return spring 76 of the actuation device 28.

The overall engine brake-on/brake-off operation is described hereafter.

The positive power operation, i.e., normal brake-off operation, of the engine is as follows. The solenoid valve 110 is de-energized and is thus switched to the low pressure stage. Accordingly, the low inlet pressure hydraulic fluid is supplied from the outlet cavity 123 of the de-energized solenoid valve 110 to the exhaust rocker assembly 16. The supply conduit 21 provides continuous flow of the low inlet pressure hydraulic fluid, such as motor oil, to the reset cavity 39 through the connecting conduit $\mathbf{23}_1$.

The low inlet pressure hydraulic fluid and the slider bias spring 50 bias the slider-piston 48 downward toward the exhaust valve bridge 24 to help maintain consistent contact between the contacting foot 52 and the exhaust valve bridge 24.

In this configuration, as a cam lobe of the exhaust valve cam 2 decreases in radius toward the lower base circle $\mathbf{4}_1$, the slider-piston 48 of the slider assembly 32 will extend outward from the exhaust rocker arm 18 to drive the rocker arm away from the exhaust valve bridge 24, while maintaining constant contact between the contacting foot 52 and the exhaust valve bridge 24. The low inlet pressure of the hydraulic fluid is set to a pressure incapable of generating sufficient force to extend the actuation piston 74 against the actuation piston return spring 76 of the actuation device 28. The combined force applied to extend the slider-piston 48 by the slider bias spring 50 and the regulated hydraulic fluid pressure will never exceed the retaining force of the exhaust valve springs $\mathbf{7}_1$ and $\mathbf{7}_2$ such that, as the exhaust rocker arm 18 is pivoted toward the exhaust valve bridge 24 by increasing radius of the cam lobe of the exhaust valve cam 2, the slider-piston 48 is retracted with respect to the exhaust rocker arm 18. During normal exhaust cam lift by the engine exhaust cam profile $\mathbf{3}_1$ of the exhaust valve cam 2, the slider-piston 48 is driven further into the exhaust rocker arm 18, taking up all lash, until it contacts the adjuster body 34 of the adjuster assembly 30, thus allowing the exhaust rocker assembly 16 to then open the exhaust valves $\mathbf{6}_1$ and $\mathbf{6}_2$.

In this fully retracted position of the slider-piston, the ball-valve member 42 is lifted off the ball-check seat 44 (to an open position of the reset check valve 36 by the upsetting pin 54). Specifically, the upsetting pin 54 lifts, through the resilient biasing action of the ball-check spring 46 and the upsetting pin 54 contact, and holds the ball-valve member 42 off the ball-check seat 44.

To start the engine brake-on mode, the solenoid valve 110 is now energized to flow the full inlet pressure hydraulic fluid through the supply conduit 21 and the connecting conduit $\mathbf{23}_1$ to the reset cavity 39. The highly pressurized engine oil is supplied to the actuation cavity 72 of the actuation device 28 through the reset check valve 36, the supply port 40 and the reset conduit $\mathbf{23}_2$, and the actuation piston check valve 84. The full inlet pressure within the actuation cavity 72 of the exhaust rocker arm 18 has a value capable of generating sufficient force to extend the actuation piston 74 against the biasing force of the actuation piston return spring 76, but still insufficient, by itself, to overcome the retaining forces of the exhaust valve $\mathbf{6}_1$.

The slider-piston 48 will continue to behave as in normal brake-off mode, whereas the actuation piston 74, on the other hand, will now extend from the actuation bore 70 of the exhaust rocker arm 18 until the piston contacting foot 82 comes into contact with the single-valve actuation pin 25. The cam lobe of the exhaust valve cam 2 will fall to the lower base circle $\mathbf{4}_1$ prior to the pre-charge lift profile $\mathbf{3}_3$ or the engine brake lift profile $\mathbf{3}_2$, allowing the exhaust rocker arm 18 to rotate away from the exhaust valve bridge 24. The lower base circle $\mathbf{4}_1$ is a point of a lowest cam radius, and at this point the exhaust rocker arm 18 will be rotated furthest from the exhaust valve bridge 24, allowing slider-piston 48 and actuation piston 74 to both be at maximum extension from the exhaust rocker arm 18. In this state, the upsetting pin 54 of the reset device 26 is farthest away from the ball-valve member 42 of the reset check valve 36.

Since upsetting pin 54 of the reset device 26 is not in contact with the ball-valve member 42 of the reset check valve 36, and because the actuation piston check valve 84 does not allow reverse hydraulic fluid flow, the hydraulic fluid will be trapped within both the actuation cavity 72 and the reset conduit $23_2$. The cam lobe of the exhaust valve cam 2 will rise as it enters the pre-charge lift profile $3_3$ or the engine brake lift profile $3_2$, which will rotate the exhaust rocker arm 18 back toward the exhaust valve bridge 24 and the force of the engine cylinder pressure acting on the face of the first exhaust valve $6_1$ and the first exhaust valve spring $7_1$ will attempt to retract the actuation piston 74 into the actuation bore 70 of the exhaust rocker arm 18 to maintain the closed position of the first exhaust valve $6_1$. The actuation piston 74 will not be retracted, rather the trapped hydraulic oil within the actuation cavity 72 and reset conduit $23_2$ will increase in pressure to support the force, and the single exhaust valve $6_1$ will be opened according to the cam lift profile.

Resetting of the first exhaust valve $6_1$ is effected as the exhaust valve cam 2 rises to the upper base upper base circle $4_2$. The forward motion (or clockwise pivoting) of the exhaust rocker arm 18 toward the valve bridge 24 causes the slider-piston 48 to retract into the reset bore 38 of the exhaust rocker arm 18, consequently moving the upsetting pin 54 toward the ball-valve member 42 of the reset check valve 36. During a compression release event, the engine cylinder pressure continues to increase as the first exhaust valve $6_1$ opens near TDC, which in turn acts on a face of the first exhaust valve $6_1$ to create a force on the actuation piston 74 through the single-valve actuation pin 25, thus further increasing the hydraulic pressure in the actuation cavity 72 of the exhaust rocker arm 18.

During the actual engine compression release event, when the engine brake lift profile $3_2$ of the exhaust valve cam 2 acts on the exhaust rocker arm 18, the engine cylinder pressure is high, and although the slider-piston 48 is retracted far enough for the upsetting pin 54 to contact the ball-valve member 42 of the reset check valve 36, the ball-valve member 42 is not lifted from the check-valve seat 44, i.e., the reset check valve 36 is not open. Instead, the pin guide 62 will be displaced within the slider-piston 48 to compress the reset pressure control spring 58 until the engine cylinder pressure falls to a value where the force created by the hydraulic pressure in the actuation cavity 72 is less than the force generated by the reset pressure control spring 58, and the ball-valve member 42 of the reset check valve 36 is lifted from the check-valve seat 44 by the upsetting pin 54, i.e., the reset check valve 36 is open. When the reset check valve 36 is open, the hydraulic pressure in the actuation cavity 72 rapidly falls. Subsequently, the force on the actuation piston 74 due to the hydraulic pressure in the actuation cavity 72 falls to a value that cannot sustain lift of the first exhaust valve $6_1$ against the combined force of the first exhaust valve spring $7_1$ and the engine cylinder pressure, the first exhaust valve $6_1$ returns to the closed position.

During the resetting of the first exhaust valve $6_1$, a portion of the hydraulic fluid in the actuation cavity 72 is discharged in order to facilitate retraction of the actuation piston 74 into the actuation bore 70 of the exhaust rocker arm 18. The optional accumulator assembly 96 is configured to manage the discharged hydraulic fluid from the exhaust rocker arm 18 to aid the hydraulic performance of the rocker arm compression-release engine brake system 12. In the presence of sufficient hydraulic pressure, the optional accumulator piston 98 moves towards the accumulator cap 104 to increase the volume of the accumulator cavity 101, which is fluidly connected with an accumulator conduit 27, and compresses the accumulator pressure control spring 102, allowing the hydraulic fluid to be stored within the accumulator cavity 101 at a predetermined pressure. When the exhaust valve cam 2 rotates to the lower base circle $4_1$, the accumulator pressure control spring 102 extends to force the displacement of the accumulator piston 98 towards the retracted position, driving the stored hydraulic fluid into the accumulator conduit 27 and the actuation cavity 72, helping to re-extend the actuation piston 74 (i.e., displacing the actuation piston 74 toward the extended position, or toward the first exhaust valve $6_1$).

The engine cylinder pressure, at which the reset of the first exhaust valve $6_1$ occurs, is tunable by adjusting characteristics of the reset pressure control spring 58. The tuning capability of the exhaust valve reset creates a reset that initiates early in the expansion stroke to ensure that the exhaust valve is closed prior to a start of a normal exhaust valve motion defined by the normal exhaust cam profile $3_1$ of the exhaust valve cam 2.

The exhaust rocker arm 18 is adjusted by loosening the adjuster nut 35 and rotating the adjuster body 34. The engine is rotated until the cam lobe of the exhaust valve cam 2 is on the upper base circle $4_2$, which occurs during the expansion stroke. The valve lash is set conventionally by inserting a shim between the contacting foot 52 and the exhaust valve bridge 24, and moving the adjuster body 34 until the mechanism is solid, which occurs when the adjuster assembly 30 contacts the slider assembly 32.

Figure 11:
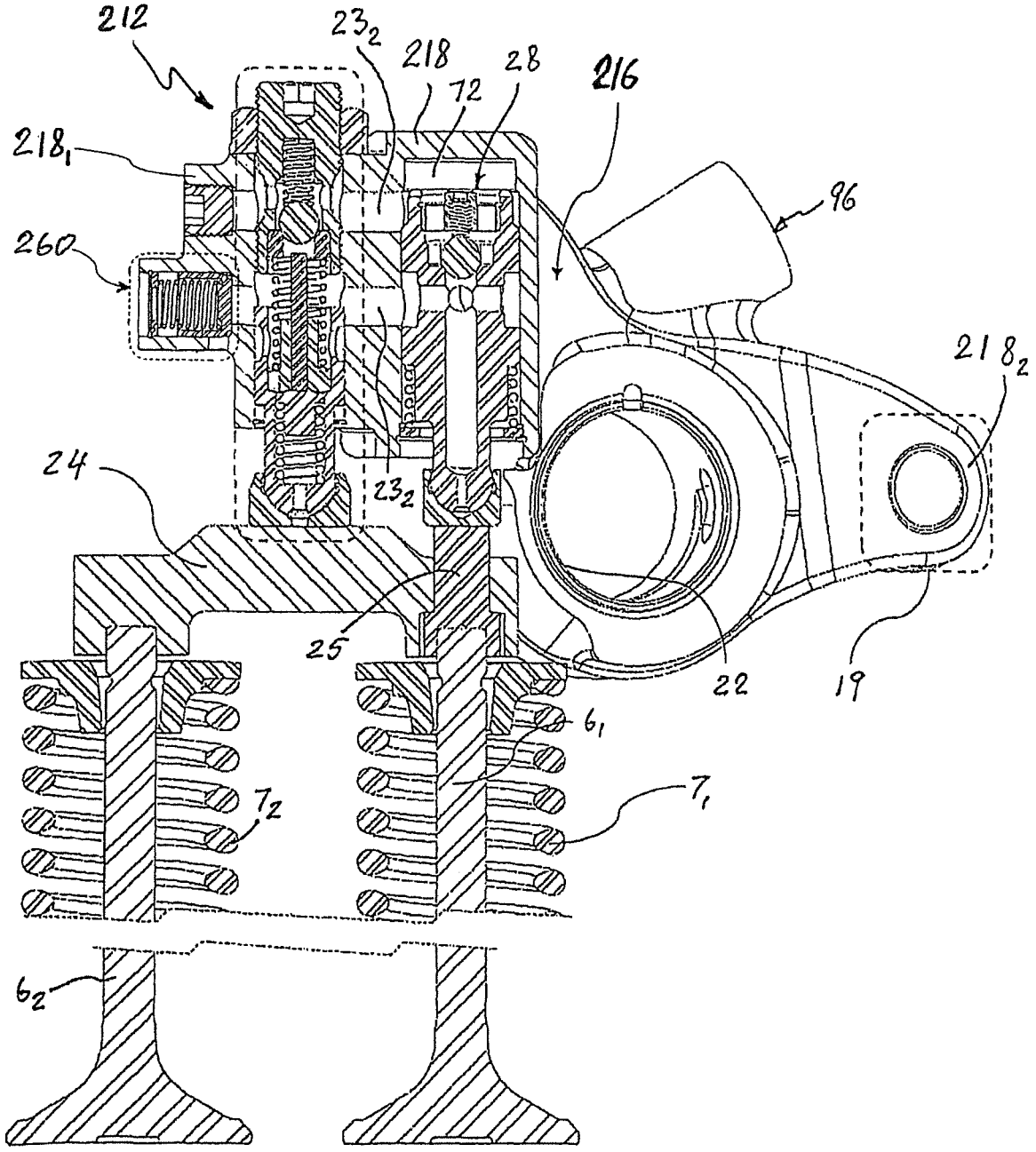
FIG. 11 is a sectional view of a rocker arm compression-release engine brake system with the lost motion exhaust rocker assembly according to a second exemplary embodiment of the present invention.
Figure 12:
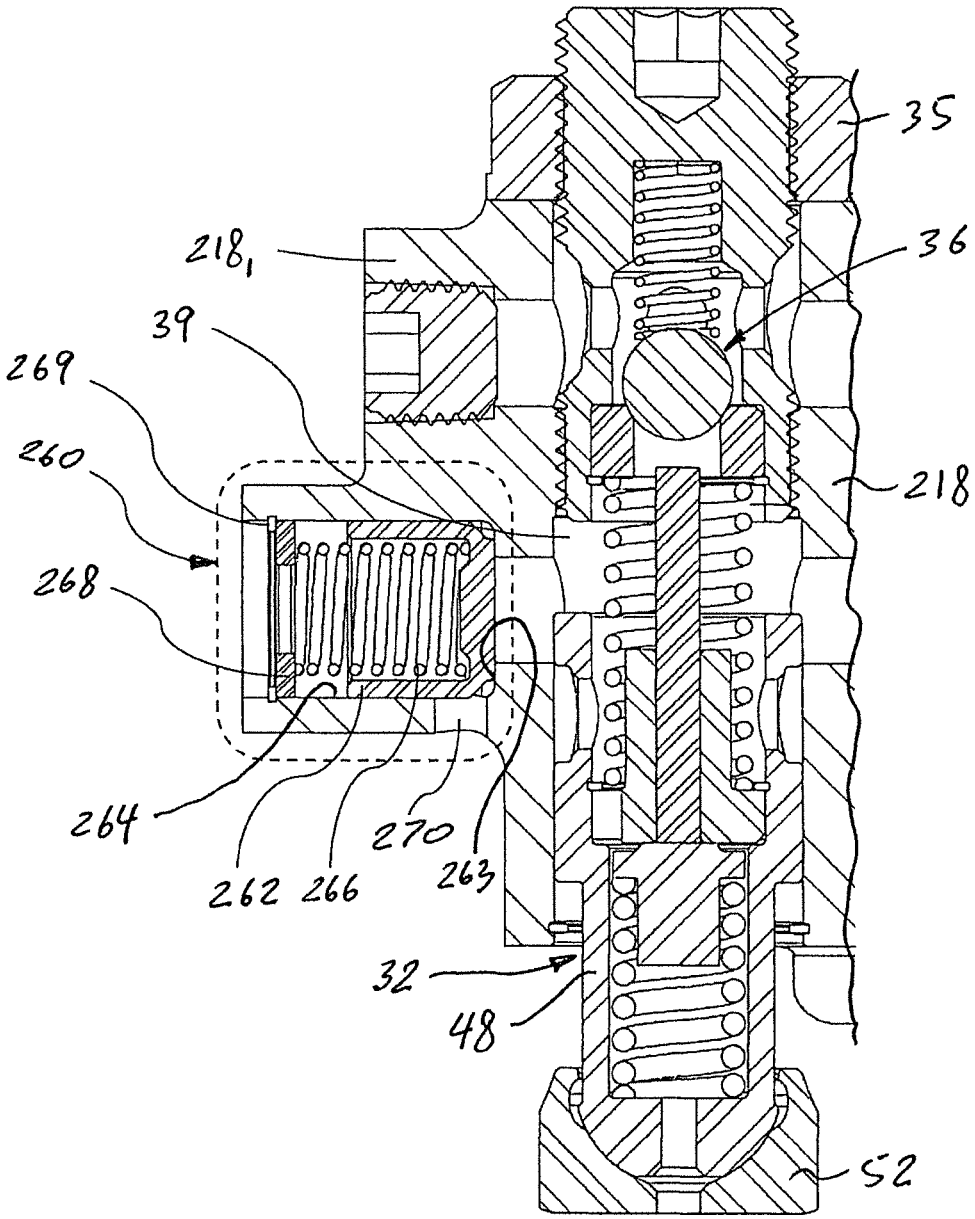
FIG. 12 is a sectional view of the reset device according to the second exemplary embodiment of the present invention.

Various modifications, changes, and alterations may be practiced with the above-described embodiment, including but not limited to the additional embodiment shown in FIGS. 11 and 12. In the interest of brevity, reference characters in FIGS. 11 and 12 that are discussed above in connection with Figs. FIGS. 1-10 are not further elaborated upon below, except to the extent necessary or useful to explain the additional embodiment of FIGS. 11 and 12. Modified components and parts are indicated by the addition of a two hundred digits to the reference numerals of the components or parts.

FIGS. 11 and 12 illustrate a second exemplary embodiment of a rocker arm compression-release engine brake system, generally depicted by the reference character 212. Components, which are unchanged from the first exemplary embodiment of the present invention, are labeled with the same reference characters. Components, which function in the same way as in the first exemplary embodiment of the present invention depicted in FIGS. 1-10 are designated by the same reference numerals to some of which 200 has been added, sometimes without being described in detail since similarities between the corresponding parts in the two embodiments will be readily perceived by the reader.

The rocker arm compression-release engine brake system 212 is provided for an IC engine. The compression-release brake system 212 operates in a compression brake mode, or brake-on mode (during the engine compression brake operation) and a compression brake deactivation mode, or brake-off mode (during the positive power operation).

The rocker arm compression-release engine brake system 212 includes a lost motion exhaust rocker assembly 216. The lost motion exhaust rocker assembly 216 according to the second exemplary embodiment of the present invention, shown in FIGS. 11 and 12, comprises an exhaust rocker arm 218 pivotally mounted about the rocker shaft 20 and provided to open the first and second exhaust valves $6_1$ and $6_2$ through the exhaust valve bridge 24. In the lost motion exhaust rocker assembly 216 of the second exemplary embodiment illustrated in FIGS. 11 and 12, a reset pressure-relief valve assembly 260 is added. The lost motion exhaust rocker assembly 216 of FIGS. 11 and 12 corresponds substantially to the lost motion exhaust rocker assembly 16 of FIGS. 3-10, and the reset pressure-relief valve assembly 260, which primarily differs, will therefore be explained in detail below.

FIG. 12 shows in detail the reset pressure-relief valve assembly 260. The reset pressure-relief valve assembly 260 includes a pressure-relief piston 262 disposed in a cylindrical pressure-relief bore 264 formed in a driving (first distal) end $\mathbf{218}_1$ of the exhaust rocker arm 218. The pressure-relief piston 262 is configured to rectilinearly reciprocate within the pressure-relief bore 264 of the exhaust rocker arm 218. The pressure-relief piston 262 is normally biased toward a seat 263 in the exhaust rocker arm 218 by a pressure-relief spring 266. Hydraulic pressure in the reset cavity 39 extends the pressure-relief piston 262 towards a washer 268, which acts as an extension limiter for the pressure-relief piston 262 and is retained by a retaining ring 269 in the pressure-relief piston 262 in the exhaust rocker arm 218. Moreover, the reset pressure-relief valve assembly 260 includes a pressure-relief port 270 extending through the exhaust rocker arm 218. When the pressure-relief piston 262 engages the seat 263 due to a biasing force of the pressure-relief spring 266, the pressure-relief port 270 in the exhaust rocker arm 218 is closed. However, when the hydraulic pressure in the reset cavity 39 moves the pressure-relief piston 262 off the seat 263, the pressure-relief port 270 in the exhaust rocker arm 218 is open, thus fluidly connecting the reset cavity 39 with a space outside the exhaust rocker arm 218.

The operation of the rocker arm compression-release engine brake system 212 of the second exemplary embodiment of the present invention is generally similar to the operation of the rocker arm compression-release engine brake system 12 of the first exemplary embodiment of the present invention.

The rate at which the actuation piston 74 retracts into the actuation bore 70 of the exhaust rocker arm 218 during reset depends upon the residual pressure within the actuation cavity 72, the adjacent reset conduit $\mathbf{23}_2$ and the reset cavity 39. At the initiation of the reset, this residual pressure can be high and sustained for a significant time period to reduce the rate of retraction of the actuation piston 74. If the hydraulic pressure is above a predetermined value, the pressure-relief piston 262 of the reset pressure-relief valve assembly 260 extends from the seat 263 in the exhaust rocker arm 218, compressing the pressure-relief spring 266 and exposing the pressure-relief port 270, allowing an immediate reduction in the residual pressure within the actuation cavity 72 and the reset cavity 39. Once the hydraulic fluid pressure falls to a predetermined value, the pressure-relief spring 266 extends to return the pressure-relief piston 262 to the seat 263 and close the pressure-relief port 270, thus limiting hydraulic fluid loss.

Alternatively, the lost motion exhaust rocker assembly 216 according to the second exemplary embodiment of the present invention may not comprise the accumulator assembly 96 and, instead, operate and manage the brake-on/brake-off hydraulic function using conduit oil supply only.

Figure 13:
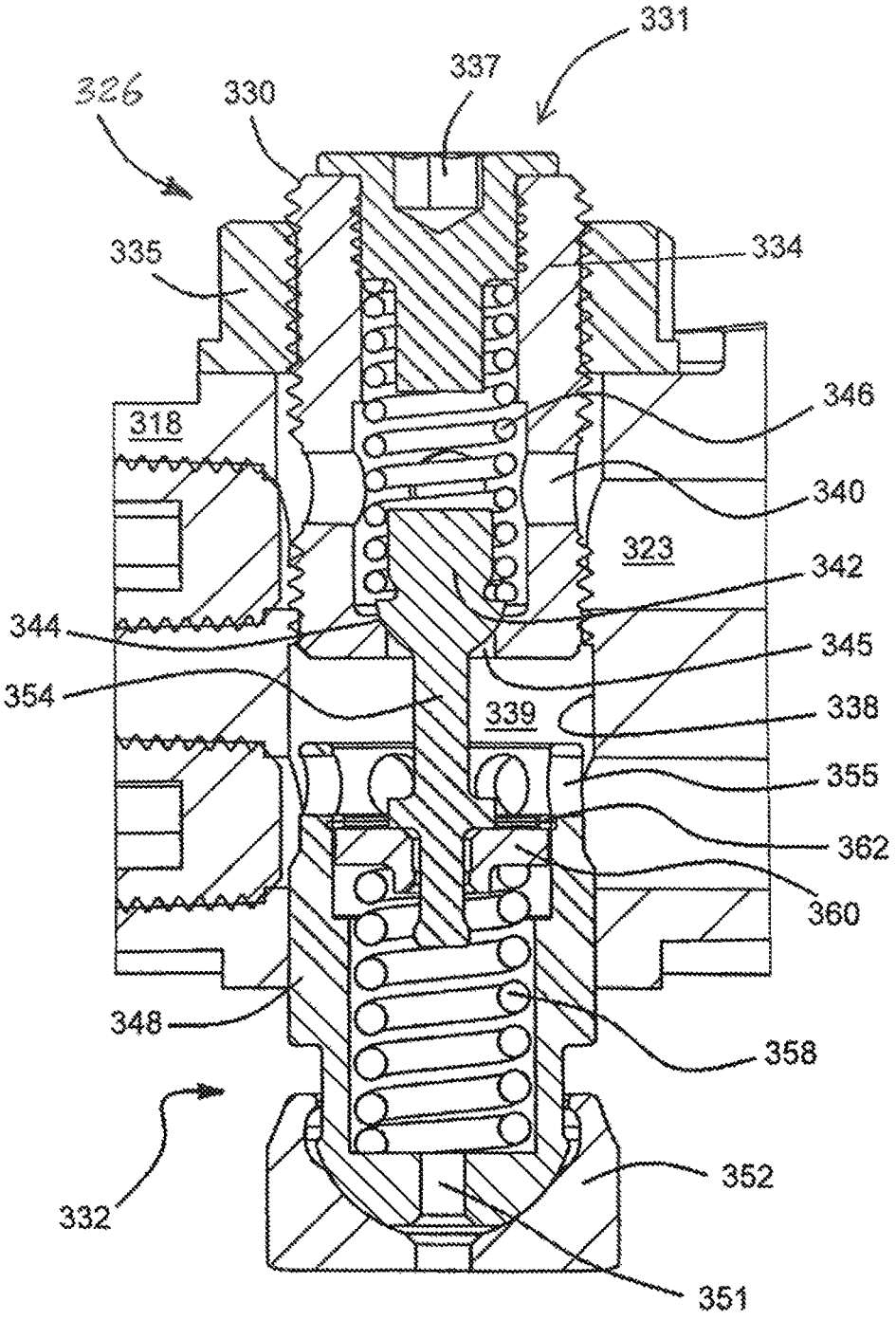
FIG. 13 is a sectional view of third exemplary embodiment of a vertically compact version of an exhaust rocker lost motion reset device in accord with the invention.

FIG. 13 shows a vertically compact version of a reset device 326 in accord with the present invention. Under hood, the proximity of the valve train to the top portion of the engine/engine cover presents a challenge when a reduced hood height is made necessary by other engine componentry and/or a reduced aero profile of the vehicle. As such, a shorter more compact version of the reset device can be constructed.

The reset device 326, shown in FIG. 13, comprises an adjuster assembly 330 and a slider assembly 332. The cylindrical reset bore 338, slider assembly 332, and adjuster assembly 330 define a reset cavity 339, within the exhaust rocker arm 318, fluidly connected with the connecting conduit 323. The adjuster assembly 330 includes an adjuster body 334, and a reset check valve 342 disposed within the adjuster body 334. The adjuster body 334 is threaded and is adjustably disposed within the cylindrical reset bore 338 formed in the exhaust rocker arm 318 to provide normal exhaust valve lash adjustment. The adjuster body 334 of the adjuster assembly 330 is provided with a socket 337, in pressure cap 331, accessible from above the exhaust rocker arm 318 for adjusting the position of the adjuster body 334 of the reset device 326. The adjuster assembly 330 is locked in position by an adjuster nut 335.

The reset check valve 342 comprises a semi spherical ball-valve element, an extending link 354, a check-valve seat 344, and a check spring 346, all disposed within the adjuster body 334 so that the valve member 342 is disposed between the check-valve seat 344 and the check spring 346. The valve member 342 is urged toward the check valve seat 344 by the biasing spring force of the check valve spring 346. The valve member 342, the check seat 344, and the check spring 346 define a reset check valve normally biased closed (i.e., into a closed position) by the ball-check spring 346. The check-valve seat 344 has a central opening 345 therethrough.

The adjuster body 334 is provided with one or more (i.e., at least one) supply ports 340. The supply ports 340 are disposed above the valve member 342 of the reset check valve so as to fluidly connect the reset cavity 339 of the reset bore 338 with the conduit 323 when the reset check valve is in the open position.

The slider assembly 332 comprises a slider-piston 348 configured to rectilinearly reciprocate within the reset cavity 339 of the exhaust rocker arm 318. The check spring 346 disposed above the check-valve biases the slider-piston 348 in a direction away from the adjuster assembly 330 and urges the slider 348, through elephants foot 352, into contact with an underlying valve bridge. The slider-piston 348 is provided with one or more (i.e., at least one) piston ports 355. The piston ports 355 are disposed below valve member 342 of the reset check valve so as to maintain fluid connection of the reset cavity 339 of the reset bore 338 with the connecting conduit 323 for all positions of the slider-piston 348.

The elongated distal end of the slider-piston 348 at least partially extends from the reset bore 338 of the exhaust rocker arm 318. A lubricating port 351 through the distal end of the slider-piston 348 provides lubricating oil to the contacting foot 352 and the exhaust valve bridge.

The slider-piston 348 is urged, in-part, by hydraulic pressure in the reset cavity 339, but mostly by the spring 346, away from the adjuster assembly 330 so as to maintain contact of the contacting foot 352 with the exhaust valve bridge during all engine operation (brake on or off). In other words, the slider-piston 348 and spring 346, through link 354, provide an active lash adjuster to absorb the large amount of lost motion between the exhaust rocker assembly and the underlying exhaust valve bridge when the compression-release engine brake system is in the brake-off mode. A retaining ring(s) 362, such as a C-ring, maintains a pre-load on reset spring 358 located beneath washer 360, and also connects the lower portion of the link 354 with the slider piston 348.

The link pin 354 is configured to contact, lift and hold the valve member 342 of the reset check valve off the check seat 344. An upper end of the link 354 is disposed adjacent to the valve member 342, while a lower end of the link 354 engages the slider-piston 48 through the retaining rings. The reset pressure control spring 358 is configured to lift, through the resilient biasing action of the reset pressure control spring 358, the link 354 during a reset operation.

The adjuster assembly 330 provides an adjustable retraction limit for the slider assembly 332 so as to establish a permanent lash between the underlying exhaust valve bridge (i.e., the stop member) and the slider-piston 348 when in the retracted position. The slider-piston 348 of the reset device 326 is configured to drive the exhaust valve bridge during normal exhaust valve motion. The clearance between the upper end of link 354, i.e., above the valve element 342, and the pressure cap 331 is sufficient to enable the slider piston 348 to make contact with, and be driven by, the lower end of adjuster body 334 during normal engine operation.

The reset device 326, as shown in FIG. 13, performs the same function in the engine brake system as does the reset device 26 as shown in FIG. 5. When a brake-on condition is activated, the slider 348 is fully extended from bore 338 toward the underlying valve bridge, and retained in the fully extended position by hydraulic pressure behind valve 342 and spring pressure 358. When the rocker 318 is rotated toward the underlying valve bridge in brake on mode, the reset spring 358, although heavier than in other embodiments herein, is initially unable to overcome the fluid and spring 346 pressure behind valve 342. However, as the reset spring 358 compresses, the IC engine cylinder pressure which, in turn, transfers pressure to the retained fluid behind valve 342, is lessened owing to a compression release being accomplished via the compression release actuation device 28 in brake on mode. As the cylinder pressure reduces, the reset spring 358 pressure is able to push link 354 upwardly and release valve 342 and reset the associated fluid connected actuation device 28 (see FIG. 6).

A rocker arm compression-release engine brake system of the present invention is an integrated resetting lost motion rocker arm engine brake system that is capable of closing the exhaust valve during expansion stroke using a pressure sensitive biasing spring. The compression-release engine brake system of the present invention solves the problems of the prior art by incorporating a reset mechanism into an active lash adjuster in the exhaust rocker arm. The reset device of the present invention utilizes a biasing spring, allowing it to restrain motion of the exhaust valve bridge and perform a lost motion lash take-up even at zero hydraulic fluid pressure. When the engine brake is energized, engine oil pressure sensitivity is not inherent to the compression-release engine brake system of the present invention. A dual stage hydraulic solenoid valve further optimizes integration simplicity by combining lubrication and engine brake actuation into a single hydraulic circuit. A part of the engine brake system of the present invention is the function of engaging or initiating the "brake-on" mode and turning off the braking mode when it is no longer desired.

Various components and features of the above-described embodiments may be substituted into one another in any combination. It is within the scope of the invention to make the modifications necessary or desirable to incorporate one or more components and features of any one embodiment into any other embodiment.

The foregoing description of the exemplary embodiments of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A compression-release engine brake system for effectuating a compression-release engine braking operation in connection with an internal combustion engine comprising an engine cylinder, at least one intake valve, first and second exhaust valves and first and second exhaust valve springs each exerting a closing force on one of the first and second exhaust valves to urge each of the first and second exhaust valves into a closed position, the engine cylinder being associated with a four stroke piston cycle comprising an intake stroke, a compression stroke, an expansion stroke and an exhaust stroke, the compression-release system comprising a lost motion exhaust rocker assembly comprising:

an exhaust rocker arm;

an actuation device including an actuation piston slidably disposed in an actuation bore formed in the exhaust rocker arm and movable between retracted and extended positions, the actuation device configured to be operatively associated with the first exhaust valve to permit unseating thereof from the closed position;

a reset device including a reset check valve and a slider assembly operatively connected to the reset check valve; and a hydraulic fluid circuit within the exhaust rocker arm;

the actuation bore defining an actuation cavity delimited by the actuation piston within the actuation bore above the actuation piston, the reset check valve disposed in a reset bore formed in the exhaust rocker arm, the reset bore being in fluid communication with the actuation cavity through at least one connecting conduit of the hydraulic fluid circuit, the reset check valve operable between an open position and a closed position and biased toward the closed position thereof so that a hydraulic fluid is locked in the actuation cavity when the reset check valve is in the closed position thereof, and flows bi-directionally through the reset check valve when the reset check valve is in the open position;

the slider assembly includes a slider-piston slidably disposed in the reset bore of the exhaust rocker arm, the slider-piston movable relative to the exhaust rocker arm between an extended position and a retracted position, the slider-piston biased toward the extended position, the slider assembly operatively associated with the reset check valve so that in the extended position the reset check valve is free to move toward the closed position, and in the retracted position the reset check valve is movable to the open position thereof by the slider-piston.

2. The compression-release engine brake system as defined in claim 1, wherein the slider assembly further includes a reset pressure control spring and a reset spring cap both disposed in the slider-piston, wherein the reset spring cap is slidably moveable relative to the slider-piston, wherein the slider-piston is operatively associated with a stop member such that when the exhaust rocker arm is farthest away from the stop member the slider-piston is in the extended position, and as the exhaust rocker arm rotates toward the stop member the slider-piston is moved toward the retracted position, wherein the slider-piston opens the reset check valve in the retracted position of the slider-piston, and wherein:

if the force caused by the hydraulic pressure within the actuation cavity acting on the reset check valve is higher than a biasing force of the reset pressure control spring, the reset spring cap moves within the slider-piston away from the reset check valve thereby compressing the reset pressure control spring and allowing the reset check valve to remain in the closed position, and if the force caused by the hydraulic pressure within the actuation cavity acting on the reset check valve is lower than the biasing force of the reset pressure control spring, the reset spring cap moves within the slider-piston toward the reset check valve thereby opening the reset check valve.

3. The compression-release engine brake system as defined in claim 2, wherein the reset device further comprises an upsetting pin configured to rectilinearly reciprocate within the reset bore of the exhaust rocker arm, wherein the upsetting pin is disposed between the reset spring cap and the reset check valve, and wherein the reset spring cap moves within the slider-piston toward the reset check valve to open the reset check valve via the upsetting pin.

4. The compression-release engine brake system as defined in claim 2, wherein the compression-release brake system is configured for installation on the internal combustion engine and operation in a brake-on mode whereby sufficiently pressurized hydraulic fluid is supplied to the lost motion exhaust rocker assembly to permit displacement of the actuation piston to the extended position thereof so that:

after a normal exhaust valve motion ends, the lost motion exhaust rocker assembly is forced away from the stop member such that the actuation piston extends to engage the first exhaust valve and the reset check valve closes, trapping the hydraulic fluid within the actuation cavity, during the compression stroke, the lost motion exhaust rocker assembly is forced toward the stop member and the hydraulic fluid trapped in the actuation cavity of the actuation device builds sufficient pressure to cause the lost motion exhaust rocker assembly to unseat the first exhaust valve from the closed position, after a compression release event, the reset pressure control spring is configured to move the reset check valve into the open position to release a portion of the hydraulic fluid within the actuation cavity and allow the first exhaust valve spring to move the first exhaust valve toward the closed position.

5. The compression-release engine brake system as defined in claim 2, wherein a biasing force of the reset pressure control spring is set to allow the first exhaust valve to return to the closed position during the expansion stroke prior to the normal exhaust valve motion on each engine cycle.

6. The compression-release engine brake system as defined in claim 5, wherein during the intake stroke, the lost motion exhaust rocker assembly is forced toward the stop member and the trapped hydraulic fluid builds sufficient pressure to cause the lost motion exhaust rocker assembly to move the first and second exhaust valves toward the open position, and wherein the first and second exhaust valves in the open positions return to the closed positions prior to the compression release event.

7. The compression-release engine brake system as defined in claim 2, wherein the compression release brake system is configured for installation on the internal combustion engine and operation in brake-off mode, wherein the compression release brake system includes a lubricating circuit, wherein the pressurized hydraulic fluid is oil that lubricates the lost motion exhaust rocker assembly through the lubricating circuit, and wherein the lubricating circuit is separated from the hydraulic fluid circuit employed to energizes the compression-release engine brake system.

8. The compression-release engine brake system as defined in claim 2, wherein the compression release brake system is configured for installation on the internal combustion engine and operation in brake-off mode, whereby sufficient biasing force toward the retracted position is applied to the actuation piston to allow the hydraulic fluid to flow through the hydraulic fluid circuit within the lost motion exhaust rocker assembly without energizing the compression-release engine brake system.

9. The compression-release brake system as defined in claim 2, wherein the actuation device further comprises an actuation piston check valve disposed within the actuation bore of the actuation device, wherein the actuation piston check valve is configured to move between a closed position and an open position to provide a unidirectional hydraulic fluid flow pathway through the actuation piston to the actuation cavity in the exhaust rocker arm above the actuation piston, and wherein the pressurized hydraulic fluid is trapped within the actuation cavity when the actuation piston check valve is in the closed position, and flows unidirectionally into the actuation cavity when the actuation piston check valve is in the open position.

10. The compression-release brake system as defined in claim 1, wherein the actuation piston check valve is disposed within the actuation piston.

11. The compression-release engine brake system as defined in claim 2, wherein the stop member is an exhaust valve bridge of the internal combustion engine.

12. The compression-release engine brake system as defined in claim 1, wherein the reset device further includes an adjuster assembly configured to provide a normal exhaust valve lash adjustment.

13. The compression-release engine brake system as defined in claim 2, wherein the lost motion exhaust rocker assembly further comprises an accumulator assembly integrated in the exhaust rocker arm, wherein the accumulator assembly comprises an accumulator piston and an accumulator pressure control spring biasing the accumulator piston such that the hydraulic fluid discharged from the actuation cavity is stored within the lost motion exhaust rocker assembly at a sufficient pressure to refill the actuation cavity on a subsequent engine cycle.

14. The compression-release engine brake system as defined in claim 2, wherein the lost motion exhaust rocker assembly further comprises a reset pressure-relief valve assembly including:

a pressure-relief piston disposed in a pressure-relief bore formed in the exhaust rocker arm and movable therein;

a pressure-relief spring biasing the pressure-relief piston toward a seat formed in the pressure-relief bore in the exhaust rocker arm; and a pressure-relief port extending through the exhaust rocker arm such that the hydraulic fluid discharged from the activation cavity into the reset bore is evacuated from the lost motion rocker assembly through the pressure-relief port of the reset pressure-relief valve assembly as long as a hydraulic fluid pressure is within the activation cavity is above a predetermined pressure.

15. The compression-release brake system as defined in claim 1, further comprising a dual stage hydraulic solenoid valve for controlling hydraulic pressure in the compression relief engine brake system, the dual stage hydraulic solenoid valve including:

a valve body having an intake port, an outlet port and an exhaust port;

a solenoid coil disposed in the valve body;

an armature rectilinearly reciprocating within the solenoid coil;

a solenoid pin rectilinearly reciprocating within the valve body and operatively associated with the armature;

an intake valve disposed between the intake port and the outlet port; and a pressure regulating exhaust valve disposed between the outlet port and the exhaust port;

wherein the pressurized hydraulic fluid supplied to the valve body through the intake port is regulated so as to flow through both the outlet port and the exhaust port via the pressure regulating exhaust valve when the solenoid coil is in a de-energized state and, when the solenoid coil is in an energized state, the pressure regulating exhaust valve is closed and the intake valve is opened so as to supply the pressurized hydraulic fluid only to the outlet port.

16. The compression-release engine brake system as defined in claim 15, wherein the dual stage hydraulic solenoid valve further comprises a bypass port associated with the intake valve and providing for pressurized fluid by-pass from the intake port to the outlet port when the solenoid coil of the dual stage hydraulic solenoid valve is in the de-energized state.

17. The compression-release engine brake system as defined in claim 15, wherein the internal combustion engine is a diesel engine, and wherein the compression-release engine brake system is actuated by the dual stage hydraulic solenoid valve.

18. A compression-release engine brake system for effectuating a compression-release engine braking operation in a diesel engine comprising an engine cylinder, at least one intake valve, first and second exhaust valves and first and second exhaust valve springs each exerting a closing force on one of the first and second exhaust valves to urge each of the first and second exhaust valves into a closed position, the engine cylinder being associated with a four stroke piston cycle comprising an intake stroke, a compression stroke, an expansion stroke and an exhaust stroke, the brake system comprising:

an exhaust rocker arm;

an actuation device including an actuation piston slidably disposed in an actuation bore formed in the exhaust rocker arm and movable between retracted and extended positions, the actuation device configured to be operatively associated with the first exhaust valve to permit unseating thereof from the closed position;

a reset device including a reset check valve and a slider assembly operatively connected to the reset check valve; and a hydraulic fluid circuit within the exhaust rocker arm;

the actuation bore defining an actuation cavity delimited by the actuation piston within the actuation bore above the actuation piston, the reset check valve disposed in a reset bore formed in the exhaust rocker arm, the reset bore being in fluid communication with the actuation cavity through at least one connecting conduit of the hydraulic fluid circuit, the reset check valve operable between an open position and a closed position and biased toward the closed position thereof so that a hydraulic fluid is locked in the actuation cavity when the reset check valve is in the closed position thereof, and flows bi-directionally through the reset check valve when the reset check valve is in the open position;

the slider assembly includes a slider-piston slidably disposed in the reset bore of the exhaust rocker arm, the slider-piston movable relative to the exhaust rocker arm between an extended position and a retracted position, the slider-piston biased toward the extended position, the slider assembly operatively associated with the reset check valve so that in the extended position the reset check valve is free to move toward the closed position, and in the retracted position the reset check valve is movable to the open position thereof by the slider-piston; and, the compression-release brake system actuated by a dual stage hydraulic solenoid valve, the dual stage hydraulic solenoid valve including:

a valve body having an intake port, an outlet port and an exhaust port;

a solenoid coil disposed in the valve body;

an armature rectilinearly reciprocating within the solenoid coil;

a solenoid pin rectilinearly reciprocating within the valve body and operatively associated with the armature;

an intake valve disposed between the intake port and the outlet port; and a pressure regulating exhaust valve disposed between the outlet port and the exhaust port;

wherein the pressurized hydraulic fluid supplied to the valve body through the intake port is regulated so as to flow through both the outlet port and the exhaust port via the pressure regulating exhaust valve when the solenoid coil is in a de-energized state and, when the solenoid coil is in an energized state, the pressure regulating exhaust valve is closed and the intake valve is opened so as to supply the pressurized hydraulic fluid only to the outlet port.

19. A method of operation of a compression-release engine brake system in a brake-on mode for operating at least one of first and second exhaust valves of an internal combustion engine during a compression-release engine braking operation, the compression-release brake system maintaining the first exhaust valve open during a portion of a compression stroke of the engine when performing the compression-release engine braking operation, the compression-release brake system comprising a lost motion exhaust rocker assembly comprising:

an exhaust rocker arm;

an actuation device including an actuation piston slidably disposed in a actuation bore formed in the exhaust rocker arm and movable between retracted and extended positions, the actuation device configured to be operatively associated with the first exhaust valve to permit unseating thereof from the closed position;

a reset device including a reset check valve and a slider assembly operatively connected to the reset check valve; and a hydraulic fluid circuit within the exhaust rocker arm;

the actuation bore defining an actuation cavity delimited by the actuation piston within the actuation bore above the actuation piston, the reset check valve disposed in a reset bore formed in the exhaust rocker arm, the reset bore being in fluid communication with the actuation cavity through at least one connecting conduit of the hydraulic fluid circuit, the reset check valve operable between an open position and a closed position and biased toward the closed position thereof so that a hydraulic fluid is locked in the actuation cavity when the reset check valve is in the closed position thereof, and flows bi-directionally through the reset check valve when the reset check valve is in the open position;

the slider assembly including a slider-piston slidably disposed in the reset bore of the exhaust rocker arm, the slider-piston movable relative to the exhaust rocker arm between an extended position and a retracted position, the slider-piston biased toward the extended position thereof, the slider assembly operatively associated with the reset check valve so that in the extended position of the slider-piston the reset check valve is free to move toward the closed position thereof, and in the retracted position of the slider-piston the reset check valve is moved to the open position thereof by the slider-piston;

the method comprising the steps of:

mechanically and hydraulically biasing the reset check valve closed during a valve brake lift of the first exhaust valve during a compression stroke of the internal combustion engine; and resetting the at least one exhaust valve during an expansion stroke of the engine by opening the reset check valve and releasing hydraulic fluid from the actuation piston cavity to close the first exhaust valve.

* * * * *